US007315122B2

(12) United States Patent
Kwon et al.

(10) Patent No.: US 7,315,122 B2
(45) **Date of Patent: *Jan. 1, 2008**

(54) PLASMA DISPLAY PANEL

(75) Inventors: Jae-Ik Kwon, Ahsan (KR); Kyoung-Doo Kang, Seoul (KR); Seok-Gyun Woo, Asan (KR); Woo-Tae Kim, Yongin (KR); Hun-Suk Yoo, Cheonan (KR)

(73) Assignee: Samsung SDI Co., Ltd., Suwon-si (KR)

( * ) Notice: Subject to any disclaimer, the term of this patent is extended or adjusted under 35 U.S.C. 154(b) by 321 days.

This patent is subject to a terminal disclaimer.

(21) Appl. No.: 10/751,341

(22) Filed: Jan. 2, 2004

(65) Prior Publication Data

US 2004/0201350 A1 Oct. 14, 2004

(30) Foreign Application Priority Data

| | | |
|---|---|---|
| Jan. 2, 2003 | (KR) | 10-2003-0000088 |
| Jul. 4, 2003 | (KR) | 10-2003-0045200 |
| Jul. 4, 2003 | (KR) | 10-2003-0045202 |
| Jul. 22, 2003 | (KR) | 10-2003-0050278 |
| Jul. 30, 2003 | (KR) | 10-2003-0052598 |
| Aug. 1, 2003 | (KR) | 10-2003-0053461 |

(51) Int. Cl.
*H01J 17/49* (2006.01)

(52) U.S. Cl. ..... 313/584; 313/585

(58) Field of Classification Search ..... 313/581–587
See application file for complete search history.

(56) References Cited

U.S. PATENT DOCUMENTS

| | | | |
|---|---|---|---|
| 5,640,068 | A | 6/1997 | Amemiya |
| 5,952,782 | A | 9/1999 | Nanto et al. |
| 6,200,182 | B1 | 3/2001 | Nanto et al. |
| 6,249,264 | B1 | 6/2001 | Sano et al. |
| 6,288,488 | B1 | 9/2001 | Amemiya |
| 6,373,195 | B1 | 4/2002 | Whang et al. |
| 6,376,986 | B1 | 4/2002 | Takagi et al. |
| 6,424,095 | B1 | 7/2002 | Hirao et al. |
| 6,479,932 | B1 | 11/2002 | Nunomura |
| 6,495,957 | B2 | 12/2002 | Kurogi et al. |

(Continued)

FOREIGN PATENT DOCUMENTS

| | | | |
|---|---|---|---|
| CN | 1264914 | A | 8/2000 |

(Continued)

*Primary Examiner*—Ashok Patel
(74) *Attorney, Agent, or Firm*—Christie, Parker & Hale, LLP

(57) ABSTRACT

A plasma display panel. A first substrate and a second substrate are provided opposing one another with a predetermined gap therebetween. Address electrodes are formed on the second substrate. Barrier ribs are mounted between the first substrate and the second substrate, the barrier ribs defining a plurality of discharge cells and a plurality of non-discharge regions. Phosphor layers are formed within each of the discharge cells. Discharge sustain electrodes are formed on the first substrate. The non-discharge regions are formed in areas encompassed by discharge cell abscissas and ordinates that pass through centers of each of the discharge cells. Further, each of the discharge cells is formed such that ends thereof increasingly decrease in width along a direction the discharge sustain electrodes are formed as a distance from a center of the discharge cells is increased along a direction the address electrodes are formed.

4 Claims, 27 Drawing Sheets

U.S. PATENT DOCUMENTS

| | | | |
|---|---|---|---|
| 6,522,072 | B1 | 2/2003 | Yura et al. |
| 6,534,914 | B2 | 3/2003 | Amemiya et al. |
| 6,608,441 | B2 | 8/2003 | Kunii et al. |
| 6,639,363 | B2 | 10/2003 | Amatsuchi et al. |
| 6,657,386 | B2 | 12/2003 | Koshio et al. |
| 6,670,754 | B1 | 12/2003 | Murai et al. |
| 6,703,772 | B2 | 3/2004 | Hasegawa et al. |
| 6,707,259 | B2 | 3/2004 | Nagao et al. |
| 6,838,828 | B2 | 1/2005 | Joo et al. |
| 6,853,136 | B2 | 2/2005 | Kim et al. |
| 6,870,314 | B2 | 3/2005 | Kifune et al. |
| 6,946,785 | B2 | 9/2005 | Ito et al. |
| 2002/0021090 | A1 | 2/2002 | Sano et al. |
| 2002/0063510 | A1 | 5/2002 | Yura et al. |
| 2003/0193487 | A1 | 10/2003 | Yatsuda et al. |
| 2004/0051457 | A1 | 3/2004 | Kimura et al. |
| 2004/0085264 | A1 | 5/2004 | Takada et al. |
| 2004/0263078 | A1 | 12/2004 | Woo et al. |
| 2005/0001551 | A1 | 1/2005 | Kim et al. |
| 2005/0017637 | A1 | 1/2005 | Kang et al. |
| 2005/0029939 | A1 | 2/2005 | Woo et al. |
| 2005/0088094 | A1 | 4/2005 | Kim et al. |
| 2005/0212430 | A1 | 9/2005 | Ahn et al. |

FOREIGN PATENT DOCUMENTS

| | | | |
|---|---|---|---|
| CN | 1267877 | A | 9/2000 |
| CN | 1327253 | A | 12/2001 |
| CN | 1337665 | A | 2/2002 |
| CN | 1344005 | A | 4/2002 |
| CN | 1397976 | A | 2/2003 |
| EP | 0 920 048 | A2 | 6/1999 |
| EP | 1 263 014 | A1 | 12/2002 |
| EP | 2003-303550 | | 10/2003 |
| EP | 2003-303551 | | 10/2003 |
| JP | 4-298936 | | 10/1992 |
| JP | 5-94772 | | 4/1993 |
| JP | 6-44907 | | 2/1994 |
| JP | 6-342631 | | 12/1994 |
| JP | 10-149771 | | 6/1998 |
| JP | 10-269951 | | 10/1998 |
| JP | 10-283934 | | 10/1998 |
| JP | 10-308179 | | 11/1998 |
| JP | 10-334811 | | 12/1998 |
| JP | 11-96921 | | 4/1999 |
| JP | 11-213893 | | 8/1999 |
| JP | 11-317170 | | 11/1999 |
| JP | 11-345570 | | 12/1999 |
| JP | 2000-11899 | | 1/2000 |
| JP | 2000-21313 | | 1/2000 |
| JP | 2000-42661 | | 2/2000 |
| JP | 2000-187200 | | 7/2000 |
| JP | 2000-195431 | | 7/2000 |
| JP | 2000-323045 | | 11/2000 |
| JP | 2000-357459 | | 12/2000 |
| JP | 2001-160361 | | 6/2001 |
| JP | 2001-210241 | | 8/2001 |
| JP | 2001-283734 | | 10/2001 |
| JP | 2001-345054 | | 12/2001 |
| JP | 2002-25451 | | 1/2002 |
| JP | 2002-83545 | | 3/2002 |
| JP | 2002-190256 | | 7/2002 |
| JP | 2002-197981 | | 7/2002 |
| JP | 2002-231146 | | 8/2002 |
| JP | 2002-245943 | | 8/2002 |
| JP | 2002-260537 | | 9/2002 |
| JP | 2002-324488 | | 11/2002 |
| JP | 2002-373593 | | 12/2002 |
| JP | 2003-16944 | | 1/2003 |
| JP | 2003-31130 | | 1/2003 |
| JP | 2003-68212 | | 3/2003 |
| JP | 2003-68215 | | 3/2003 |
| JP | 2003-132805 | | 5/2003 |
| JP | 2004-164885 | | 6/2004 |
| KR | 1998-030878 | | 8/1998 |
| KR | 1999-0062632 | | 7/1999 |
| KR | 1999-0065408 | | 8/1999 |
| KR | 2001-0016651 | | 3/2001 |
| KR | 2001-0062222 | | 7/2001 |
| KR | 2001-0093724 | | 10/2001 |
| KR | 2002-0036012 | | 5/2002 |
| KR | 2002-0055807 | | 7/2002 |
| KR | 2002-0069025 | | 8/2002 |
| KR | 2003-0044667 | | 6/2003 |
| KR | 2003-0061079 | | 7/2003 |
| KR | 10-2004-0032508 | | 4/2004 |
| WO | WO99/50877 | | 10/1999 |
| WO | WO00/46832 | | 8/2000 |

PLASMA DISPLAY PANEL

CROSS REFERENCE TO RELATED APPLICATIONS

This application claims priority to and the benefit of Korea Patent Applications No. 2003-0000088 filed on Jan. 2, 2003, No. 2003-0045202 filed on Jul. 4, 2003, No. 2003-0045200 filed on Jul. 4, 2003, No. 2003-0050278 filed on Jul. 22, 2003, No. 2003-0052598 filed on Jul. 30, 2003, and No. 2003-0053461 filed on Aug. 1, 2003, all in the Korean Intellectual Property Office, the contents of which are both incorporated herein by reference.

This application is also related to:

(a) commonly assigned U.S. patent application Ser. No. 10/746,540 entitled "Plasma Display Panel" filed on Dec. 23, 2003, which claims priority to and the benefit of Korea Patent Applications No. 2003-0000088 filed on Jan. 2, 2003 and No. 2003-0045202 filed on Jul. 4, 2003; and (b) commonly assigned U.S. patent application Ser. No. 10/746,541 entitled "Plasma Display Panel" filed on Dec. 23, 2003 which claims priority to and the benefit of Korea Patent Application No. 2002-0084984 filed on Dec. 27, 2002, Korea Patent Application No. 2003-0050278 filed on Jul. 22, 2003 and Korea Patent Application No. 2003-0052598 filed on Jul. 30, 2003.

BACKGROUND OF THE INVENTION (a) Field of the Invention

The present invention relates to a plasma display panel (PDP), and more particularly, to a plasma display panel having a barrier rib structure between two substrates that defines discharge cells into independent units.

(b) Description of the Related Art

A PDP is typically a display device in which ultraviolet rays generated by the discharge of gas excite phosphors to realize predetermined images. As a result of the high resolution possible with PDPs (even with large screen sizes), many believe that they will become a major, next generation flat panel display configuration.

In a conventional PDP, with reference to FIG. 25, address electrodes 101 are formed along one direction (axis X direction in the drawing) on rear substrate 100. Dielectric layer 103 is formed over an entire surface of rear substrate 100 on which address electrodes 101 are located such that dielectric layer 103 covers address electrodes 101. Barrier ribs 105 are formed on dielectric layer 103 in a striped pattern and at locations corresponding to between address electrodes 101. Formed between barrier ribs 105 are red, green, and blue phosphor layers 107.

Formed on a surface of front substrate 110 facing rear substrate 100 are discharge sustain electrodes 114. Each of the discharge sustain electrodes 114 includes a pair of transparent electrodes 112 and a pair of bus electrodes 113. Transparent electrodes 112 and bus electrodes 113 are arranged in a direction substantially perpendicular to address electrodes 101 of rear substrate 100 (axis Y direction). Dielectric layer 116 is formed over an entire surface of front substrate 110 on which discharge sustain electrodes 114 are formed such that dielectric layer 116 covers discharge sustain electrodes 114. MgO protection layer 118 is formed covering entire dielectric layer 116.

Areas between where address electrodes 101 of rear substrate 100 and discharge sustain electrodes 114 of front substrate 110 intersect become areas that form discharge cells.

An address voltage Va is applied between address electrodes 101 and discharge sustain electrodes 114 to perform address discharge, then a sustain voltage Vs is applied between a pair of the discharge sustain electrodes 114 to perform sustain discharge. Ultraviolet rays generated at this time excite corresponding phosphor layers such that visible light is emitted through transparent front substrate 110 to realize the display of images.

However, with the PDP structure in which discharge sustain electrodes 114 are formed as shown in FIG. 25 and barrier ribs 105 are provided in a striped pattern, crosstalk may occur between adjacent discharge cells (i.e., discharge cells adjacent to one another with barrier ribs 105 provided therebetween). Further, since there is no structure provided between adjacent barrier ribs 105 for dividing the discharge cells, it is possible for mis-discharge to occur between adjacent discharge cells within adjacent barrier ribs 105. To prevent these problems, it is necessary to provide a minimum distance between discharge sustain electrons 114 corresponding to adjacent pixels. However, this limits efforts at improving discharge efficiency.

In an effort to remedy these problems, PDPs having improved electrode and barrier rib structures have been disclosed as shown in FIGS. 26 and 27.

In the PDP structure appearing in FIG. 26, although barrier ribs 121 are formed in the typical striped pattern, discharge sustain electrodes 123 are changed in configuration. That is, discharge sustain electrodes 123 include transparent electrodes 123*a* and bus electrodes 123*b*, with a pair of transparent electrodes 123*a* being formed for each discharge cell in such a manner to extend from bus electrodes 123*b* and oppose one another. U.S. Pat. No. 5,661,500 discloses a PDP with such a configuration. However, in the PDP structured in this manner, mis-discharge along the direction that barrier ribs 121 are formed remains a problem.

In the PDP structure appearing in FIG. 27, a matrix structure for barrier ribs 125 is realized. In particular, barrier ribs 125 include vertical barrier ribs 125*a* and horizontal barrier ribs 125*b* that intersect. Japanese Laid-Open Patent No. Heisei 10-149771 discloses a PDP with such a configuration.

However, with the use of such a matrix barrier rib structure, since all areas except for where the barrier ribs are formed are designed as discharge regions, there are only areas that generate heat and no areas that absorb or disperse heat. As a result, after a certain amount of time has elapsed, temperature differences occur between cells in which discharge occurs and in which discharge does not occur. These temperature differences not only affect discharge characteristics, but also result in differences in brightness, the generation of bright afterimages, and other such quality problems. Bright afterimages refers to a difference in brightness occurring between a localized area and its peripheries even after a pattern of brightness that is greater than its peripheries is displayed for a predetermined time interval then returned to the brightness of the overall screen.

Further, in the PDP having barrier ribs 125 of such a matrix structure, either the phosphor layers are unevenly formed in corner areas that define the discharge cells, or the distance from the phosphor layers to discharge sustain electrodes 127 is significant enough that the efficiency of converting ultraviolet rays into visible light is reduced.

SUMMARY OF THE INVENTION

In accordance with the present invention, a plasma display panel is provided that optimizes a structure of electrodes and discharge cells that effect discharge to thereby maximize discharge efficiency, and increase efficiency of converting vacuum ultraviolet rays to visible light such that discharge stability is ensured.

Further in accordance with the present invention, a plasma display panel is provided in which sections of barrier ribs that define discharge cells are formed in a stepped configuration to allow easy evacuation of the plasma display panel during manufacture of the same.

In one embodiment of the present invention a plasma display panel includes a first substrate and a second substrate opposing one another with a predetermined gap therebetween. Address electrodes are formed on the second substrate. Barrier ribs are mounted between the first substrate and the second substrate, the barrier ribs defining a plurality of discharge cells and a plurality of non-discharge regions. Phosphor layers are formed within each of the discharge cells. Discharge sustain electrodes are formed on the first substrate. The non-discharge regions are formed in areas encompassed by discharge cell abscissas and ordinates that pass through centers of each of the discharge cells. The discharge cell abscissas typically pass through centers of adjacent discharge cells and discharge cell ordinates typically pass through centers of adjacent discharge cells. The non-discharge regions may be respectively centered between the discharge cell abscissas that pass through centers of adjacent discharge cells and the discharge cell ordinates that pass through centers of adjacent discharge cells. Each of the non-discharge regions may be formed by the barrier ribs in a manner having an independent cell structure. The non-discharge regions are formed by barrier ribs separating adjacent discharge cells. The non-discharge regions may also be formed by barrier ribs separating diagonally adjacent discharge cells. Also, the non-discharge regions formed into independent cell structures may be divided into a plurality of individual cells. In effect, a non-discharge region may be divided into a plurality of non-discharge sub-regions by at least one partition barrier rib located within the non-discharge region. Pairs of the discharge cells adjacent in a direction the discharge sustain electrodes may be formed sharing at least one barrier rib.

In one embodiment, a plasma display panel is provided in which if a length of the discharge cells is along a direction the address electrodes are formed, each of the discharge cells is formed such that ends thereof increasingly decrease in width along a direction the discharge sustain electrodes are formed as a distance from a center of the discharge cells is increased.

In one embodiment both ends of each of the discharge cells along a direction the address electrodes are formed have an increasingly decreasing depth as a distance from a center of the discharge cells is increased, the depths being measured from an end of the barrier ribs adjacent to the first substrate in a direction toward the second substrate.

Both ends of each of the discharge cells along a direction the address electrodes are formed may have a configuration substantially in the shape of a trapezoid, may be wedge-shaped, or may be arc-shaped. Barrier ribs shared by each pair of discharge cells adjacent along a direction the discharge sustain electrodes are formed are formed in parallel.

In one embodiment, a plasma display panel is provided in which the non-discharge regions are formed in areas encompassed by discharge cell abscissas and ordinates that pass through centers of each of the discharge cells, and the barrier ribs forming the discharge cells include first barrier rib members, which are parallel to a direction the address electrodes are formed, and second barrier rib members, which are not parallel to the direction the address electrodes are formed. In one embodiment the second barrier rib members intersect the direction the address electrodes are formed.

The first barrier rib members and second barrier rib members may have different heights. The first barrier rib members may be higher or lower than the second barrier rib members.

In one embodiment, a plasma display panel is provided in which the non-discharge regions are formed in areas encompassed by discharge cell abscissas and ordinates that pass through centers of each of the discharge cells, if a length of the discharge cells is along a direction the address electrodes are formed, each of the discharge cells is formed such that ends thereof increasingly decrease in width along a direction the discharge sustain electrodes are formed as a distance from a center of the discharge cells is increased, and the discharge sustain electrodes include bus electrodes that extend such that a pair of the bus electrodes is provided for each of the discharge cells, and protrusion electrodes formed extending from each of the bus electrodes such that a pair of opposing protrusion electrodes is formed within areas corresponding to each discharge cell.

Proximal ends of the protrusion electrodes where the protrusion electrodes are connected to and extend from the bus electrodes decrease in width in the direction the bus electrodes may be formed as the distance from the center of the discharge cells is increased, and the proximal ends of the protrusion electrodes may be formed corresponding to the shape of the ends of the discharge cells.

A distal end of each of the protrusion electrodes opposite proximal ends connected to and extended from the bus electrodes may be formed including an indentation, and a first discharge gap and a second discharge gap of different sizes are formed between distal ends of opposing protrusion electrodes. In one embodiment the indentation is formed substantially in a center of the distal ends of each of the protrusion electrodes along the direction the bus electrodes are formed. Also, a protrusion may be formed to both sides of the indentations of each of the protrusion electrodes, and in one embodiment edges of the indentations of each of the protrusion electrodes are rounded with no abrupt changes in angle.

The protrusion electrodes may be transparent.

In one embodiment, the discharge cells are filled with discharge gas containing 10% or more Xenon (Xe). In another embodiment, the discharge cells are filled with discharge gas containing 10~60% Xe.

Ventilation paths are formed on the barrier ribs defining the non-discharge regions. The ventilation paths are formed as grooves in the barrier ribs to communicate the discharge cells with the non-discharge regions.

The grooves have substantially an elliptical planar configuration or a rectangular planar configuration.

In another embodiment, the discharge sustain electrodes include scan electrodes and common electrodes provided such that one scan electrode and one common electrode correspond to each row of the discharge cells, the scan electrodes and the common electrodes including protrusion electrodes that extend into the discharge cells opposing one another. The protrusion electrodes are formed such that a width of proximal ends thereof is smaller than a width of distal ends of the protrusion electrodes. The address electrodes include line regions formed along a direction the address electrodes are formed, and enlarged regions formed at predetermined locations and expanding along a direction substantially perpendicular to the direction of the line regions to correspond to the shape of protrusion electrodes of the scan electrodes.

The enlarged regions of the address electrodes are formed to a first width at areas opposing the distal ends of the protrusion electrodes, and to a second width that is smaller than the first width at areas opposing the proximal ends of the protrusion electrodes.

In yet another embodiment, the discharge sustain electrodes include scan electrodes and common electrodes provided such that one scan electrode and one common electrode correspond to each row of the discharge cells. Each of the scan electrodes and common electrodes includes bus electrodes extended along a direction substantially perpendicular to the direction the address electrodes are formed, and protrusion electrodes that extend into the discharge cells from the bus electrodes such that the protrusion electrodes of the scan electrodes oppose the protrusion electrodes of the common electrodes.

One of the bus electrodes of the common electrodes is mounted between adjacent discharge cells of every other row of the discharge cells, and the bus electrodes of the scan electrodes are mounted between adjacent discharge cells and between the bus electrodes of the common electrodes.

Further, the protrusion electrodes of the common electrodes are extended from the bus electrodes of the common electrodes into discharge cells adjacent to opposite sides of the bus electrodes, and the bus electrodes of the common electrodes have a width that is greater than a width of the bus electrodes of the scan electrodes.

DETAILED DESCRIPTION

Figure 1:
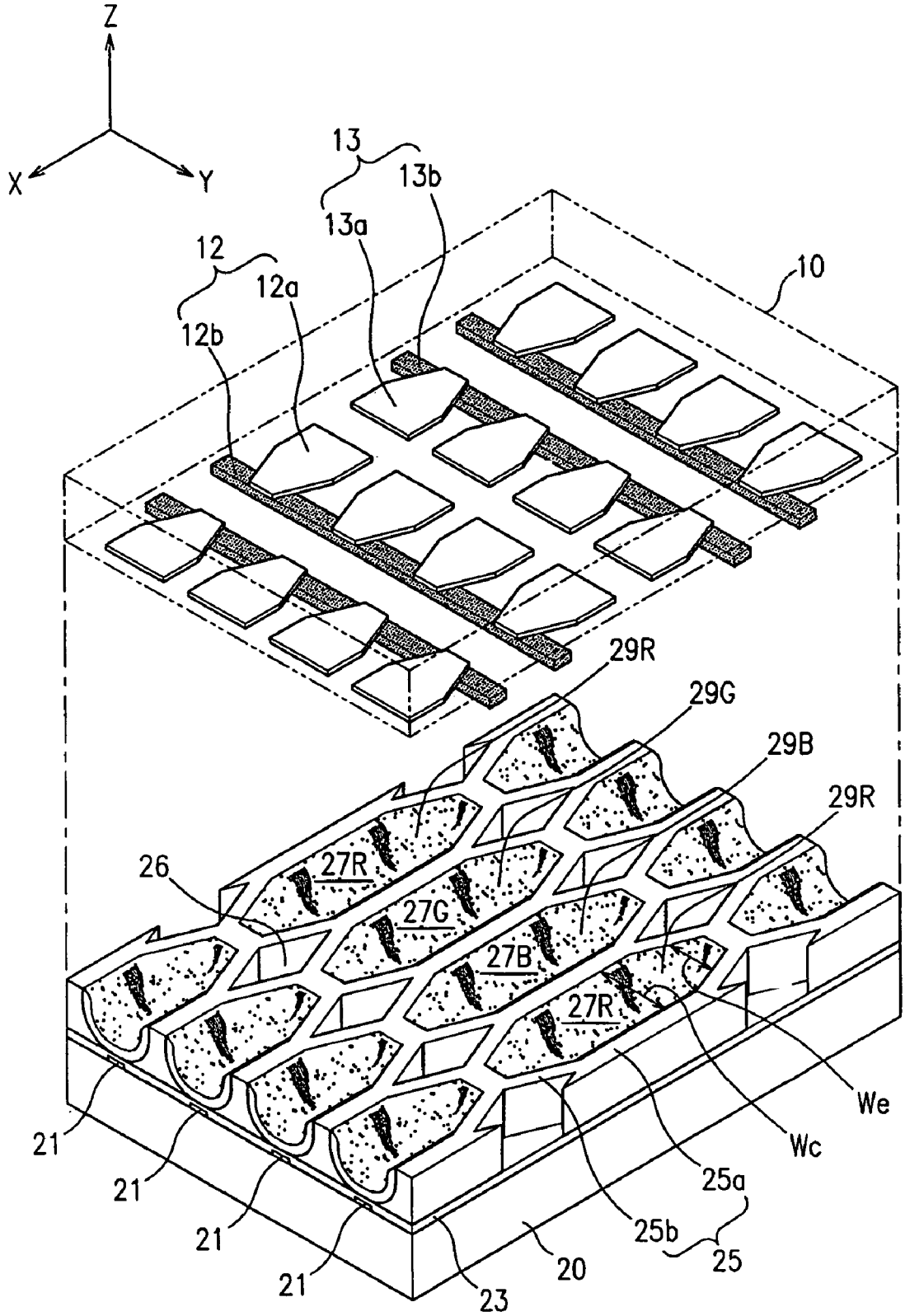
FIG. 1 is a sectional exploded perspective view of a plasma display panel according to a first embodiment of the present invention.
Figure 2:
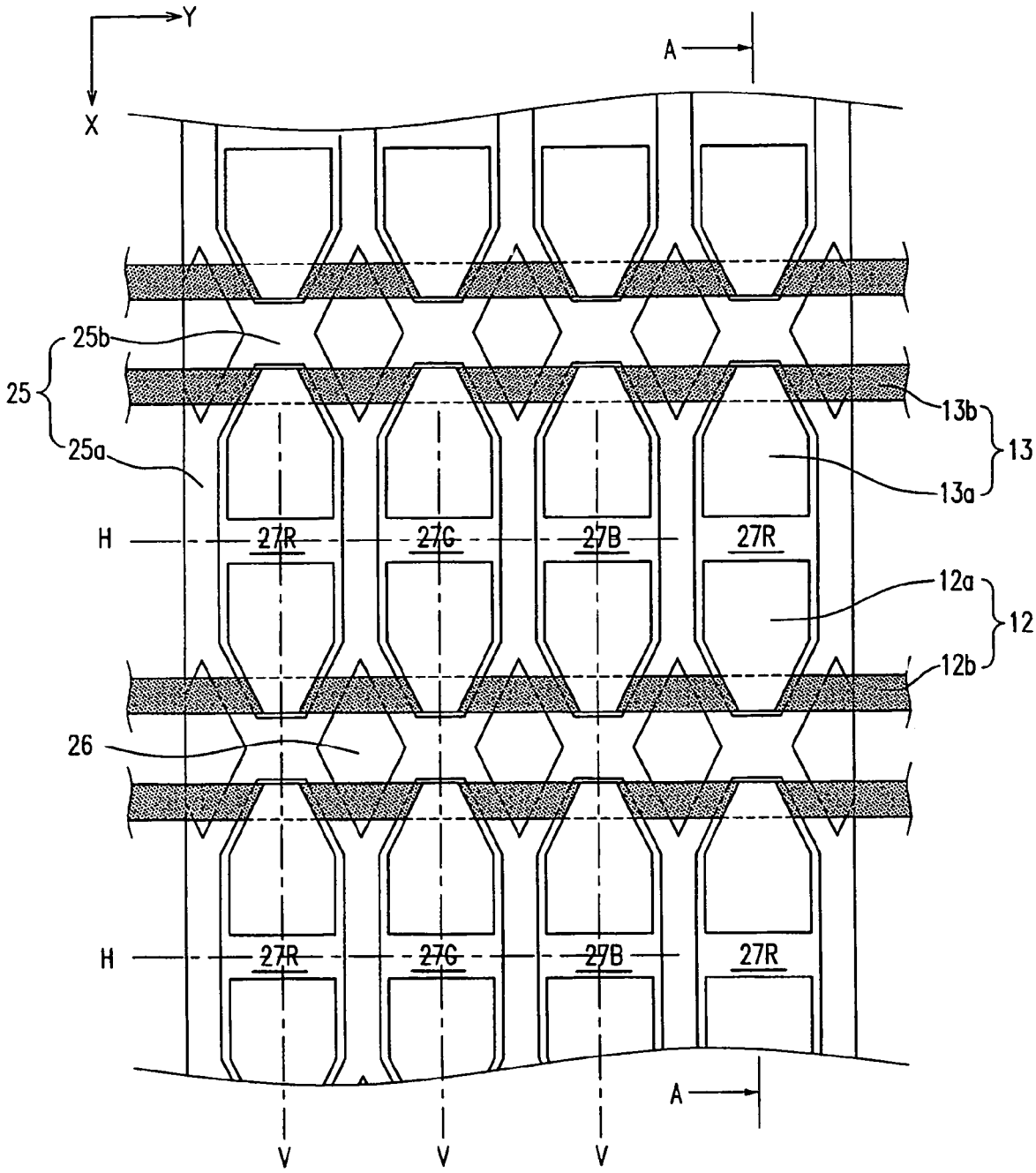
FIG. 2 is a partial plan view of the plasma display panel of FIG. 1.

FIG. 1 is a sectional exploded perspective view of a plasma display panel according to a first embodiment of the present invention with FIG. 2 being a partial plan view of the plasma display panel of FIG. 1.

A plasma display panel (PDP) according to the first embodiment includes first substrate 10 and second substrate 20 provided substantially in parallel with a predetermined gap therebetween. A plurality of discharge cells 27R, 27G, and 27B in which plasma discharge takes place is defined by barrier ribs 25 between first substrate 10 and second substrate 20. Discharge sustain electrodes 12 and 13 are formed on first substrate 10, and address electrodes 21 are formed on second substrate 20. This basic structure of the PDP will be described in greater detail below.

A plurality of address electrodes 21 is formed along one direction (direction X in the drawings) on a surface of second substrate 20 opposing first substrate 10. Address electrodes 21 are formed in a striped pattern with a uniform, predetermined interval between adjacent address electrodes 21. A dielectric layer 23 is formed on the surface of second substrate 20 on which address electrodes 21 are formed. Dielectric layer 23 may be formed extending over this entire surface of second substrate 20 to thereby cover address electrodes 21. In this embodiment, although address electrodes 21 were described as being provided in a striped pattern, the present invention is not limited to this configuration and address electrodes 21 may be formed in a variety of different patterns and shapes.

Barrier ribs 25 define the plurality of discharge cells 27R, 27G, and 27B, and also non-discharge regions 26 in the gap between first substrate 10 and second substrate 20. In one embodiment barrier ribs 25 are formed over dielectric layer 23, which is provided on second substrate 20 as described above. Discharge cells 27R, 27G, and 27B designate areas in which discharge gas is provided and where gas discharge is expected to take place with the application of an address voltage and a discharge sustain voltage. Non-discharge regions 26 are areas where a voltage is not applied such that gas discharge (i.e., illumination) is not expected to take place therein. Non-discharge regions 26 are areas that are at least as big as a thickness of barrier ribs 25 in a direction Y.

Referring to FIGS. 1 and 2, non-discharge regions 26 defined by barrier ribs 25 are formed in areas encompassed by discharge cell abscissas H and ordinates V that pass through centers of each of the discharge cells 27R, 27G, and 27B, and that are respectively aligned with direction Y and direction X. In one embodiment, non-discharge regions 26 are centered between adjacent abscissas H and adjacent ordinates V. Stated differently, in one embodiment each pair of discharge cells 27R, 27G, and 27B adjacent to one another along direction X has a common non-discharge region 26 with another such pair of discharge cells 27R, 27G, and 27B adjacent along direction Y. With this configuration realized by barrier ribs 25, each of the non-discharge regions 26 has an independent cell structure.

Discharge cells 27R, 27G, and 27B adjacent in the direction discharge sustain electrodes 12 and 13 are mounted (direction Y) are formed sharing at least one of the barrier ribs 25. Also, each of the discharge cells 27R, 27G, and 27B is formed with ends that reduce in width in the direction of discharge sustain electrodes 12 and 13 (direction Y) as a distance from a center of each of the discharge cells 27R, 27G, and 27B is increased in the direction address electrodes 21 are provided (direction X). That is, as shown in FIG. 1, a width Wc of a mid-portion of discharge cells 27R, 27G, and 27B is greater than a width We of the ends of discharge cells 27R, 27G, and 27B, with width We of the ends decreasing up to a certain point as the distance from the center of the discharge cells 27R, 27G, and 27B is increased. Therefore, in the first embodiment, the ends of discharge cells 27R, 27G, and 27B are formed in the shape of a trapezoid until reaching a predetermined location where barrier ribs 25 close off discharge cells 27R, 27G, and 27B. This results in each of the discharge cells 27R, 27G, and 27B having an overall planar shape of an octagon.

Barrier ribs 25 defining non-discharge regions 26 and discharge cells 27R, 27G, and 27B in the manner described above include first barrier rib members 25*a* that are parallel to address electrodes 21, and second barrier rib members 25*b* that define the ends of discharge cells 27R, 27G, and 27B as described above and so are not parallel to address electrodes 21. In the first embodiment, second barrier rib members 25*b* are formed extending up to a point, then extending in the direction discharge sustain electrodes 12 and 13 are formed to cross over address electrodes 21. Therefore, second barrier rib members 25*b* are formed in substantially an X shape between discharge cells 27R, 27G, and 27B adjacent along the direction of address electrodes 21. Second barrier rib members 25*b* can further separate diagonally adjacent discharge cells with a non-discharge region therebetween.

Red (R), green (G), and blue (B) phosphors are deposited within discharge cells 27R, 27G, and 27B to form phosphor layers 29R, 29G, and 29B, respectively. This will be described in more detail with reference to FIG. 3, which is a sectional view taken along line A-A of FIG. 2.

Figure 3:
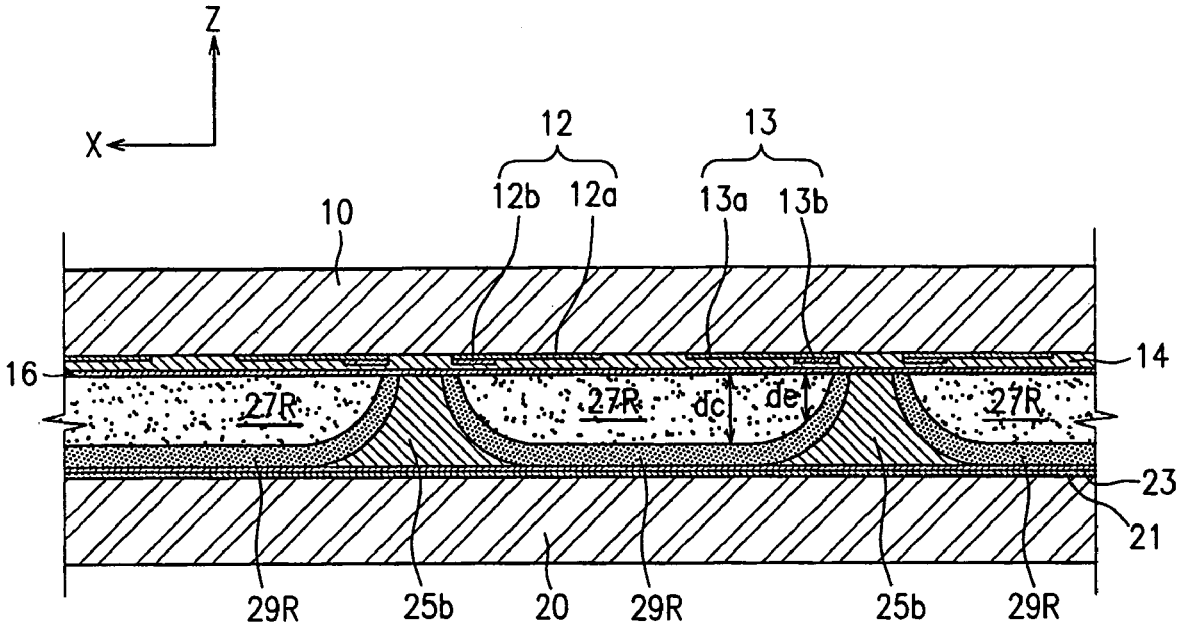
FIG. 3 is a sectional view taken along line A-A of FIG. 2.

With reference to FIG. 3, a depth at both ends of discharge cells 27R along the direction of address electrodes 21 decreases as the distance from the center of discharge cells 27R is increased. That is, a depth de at the ends of discharge cells 27R is less than a depth dc at the mid-portions of discharge cells 27R, with the depth de decreasing as the distance from the center is increased along direction X.

As a result of such a formation of depths de and dc of discharge cells 27R, distances between phosphor layers 29R and discharge sustain electrodes 12 and 13 are decreased at the ends of discharge cells 27R. Since the strength of gas discharge is relatively low at the ends of discharge cells 27R, this configuration increases the efficiency of converting vacuum ultraviolet rays to visible light in these areas. Discharge cells 27G and 27B of the other colors are formed identically to discharge cells 27R and therefore operate in the same manner.

With respect to first substrate 10, a plurality of discharge sustain electrodes 12 and 13 is formed on the surface of first substrate 10 opposing second substrate 20. Discharge sustain electrodes 12 and 13 are extended in a direction (direction Y) substantially perpendicular to the direction (direction X) of address electrodes 21. Further, dielectric layer 14 is formed over an entire surface of first substrate 10 covering discharge sustain electrodes 12 and 13, and MgO protection layer 16 is formed on dielectric layer 14. To simplify the drawings, dielectric layer 14 and MgO protection layer 16 shown in FIG. 3 are not shown in FIGS. 1 and 2.

Discharge sustain electrodes 12 and 13 respectively include bus electrodes 12*b* and 13*b* that are formed in a striped pattern, and protrusion electrodes 12*a* and 13*a* that are formed extended from bus electrodes 12*b* and 13*b*, respectively. For each row of discharge cells 27R, 27G, and 27B along direction Y, bus electrodes 12*b* are extended into one end of discharge cells 27R, 27G, and 27B, and bus electrodes 13*b* are extended into an opposite end of discharge cells 27R, 27G, and 27B. Therefore, each of discharge cells 27R, 27G, and 27B has one of the bus electrodes 12*b* positioned over one end, and one of the bus electrodes 13*b* positioned over its other end.

That is, for each row of discharge cells 27R, 27G, and 27B along direction Y, protrusion electrodes 12*a* overlap and protrude from corresponding bus electrode 12*b* into the areas of the discharge cells 27R, 27G, and 27B. Protrusion electrodes 13*a* overlap and protrude from the corresponding bus electrode 13*b* into the areas of discharge cells 27R, 27G, and 27B. Therefore, one protrusion electrode 12*a* and one protrusion electrode 13*a* are formed opposing one another in each area corresponding to each of the discharge cells 27R, 27G, and 27B.

Proximal ends of protrusion electrodes 12*a* and 13*a* (i.e., where protrusion electrodes 12*a* and 13*a* are attached to and extend from bus electrodes 12*b* and 13*b*, respectively) are formed corresponding to the shape of the ends of discharge cells 27R, 27G, and 27B. That is, the proximal ends of protrusion electrodes 12*a* and 13*a* reduce in width along direction Y as the distance from the center of discharge cells 27R, 27G, and 27B along direction X is increased to thereby correspond to the shape of the ends of discharge cells 27R, 27G, and 27B.

Protrusion electrodes 12*a* and 13*a* are realized through transparent electrodes such as ITO (indium tin oxide) electrodes. In one embodiment, metal electrodes are used for bus electrodes 12*b* and 13*b*.

Figure 4:
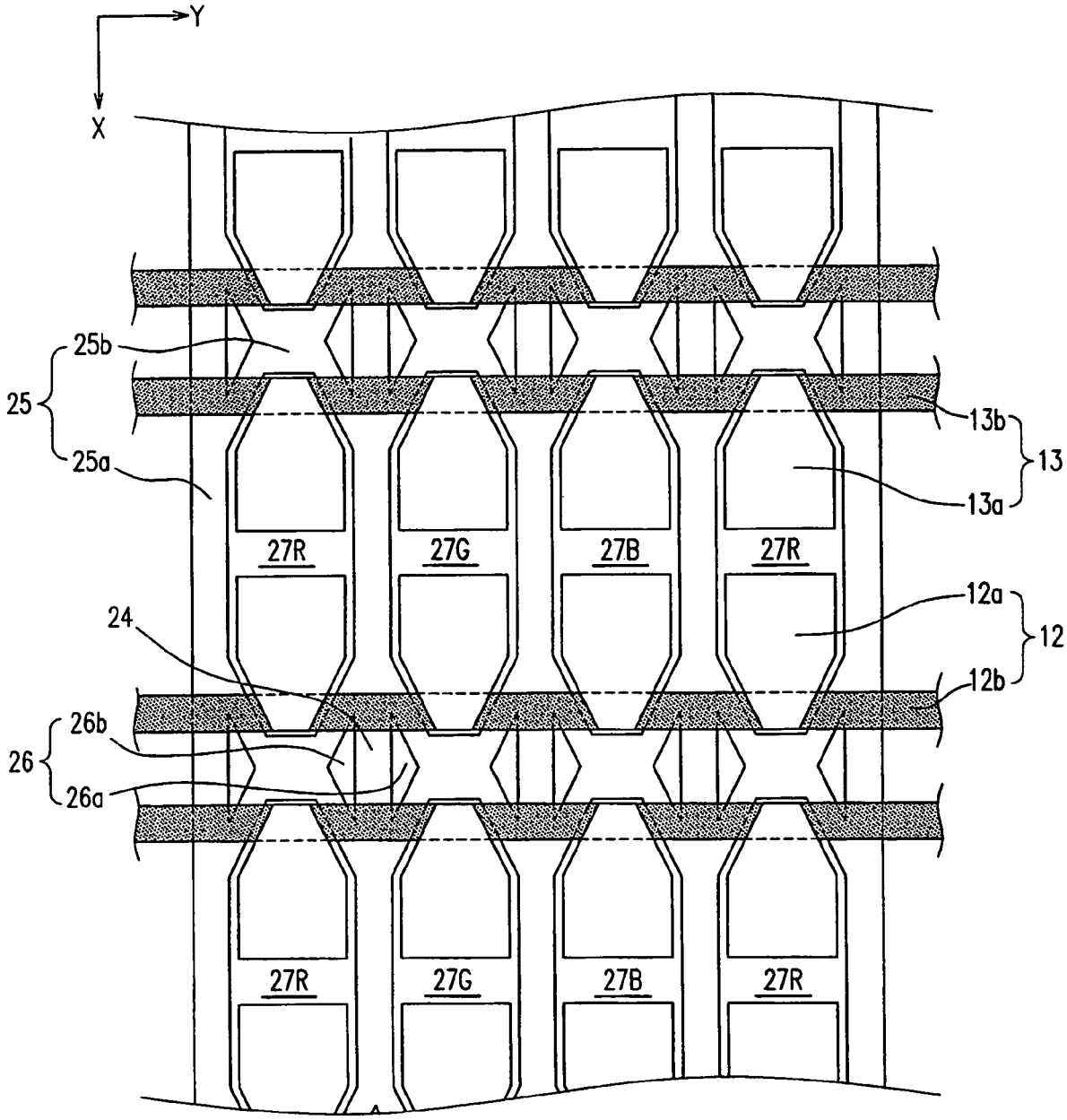
FIG. 4 is a partial plan view of a modified example of the plasma display panel of FIG. 1.

FIG. 4 is a partial plan view of a modified example of the plasma display panel of FIG. 1. Partition barrier ribs 24 are formed in direction X passing through centers of non-discharge regions 26. Partition barrier ribs 24 may be formed by extending first barrier rib members 25*a*. With the formation of partition barrier ribs 24, non-discharge regions 26 are divided into two sections 26*a* and 26*b* forming non-discharge sub-regions. It should be noted that non-discharge regions 26 may be divided into more than the two sections depending on the number and formation of partition barrier ribs 24.

In the following, PDPs according to second through eighth embodiments of the present invention will be described. In these PDPs, although the basic structure of the PDP of the first embodiment is left intact, the barrier rib structure of second substrate 20 and the discharge sustain electrode structure of first substrate 10 are changed to improve discharge efficiency. Like reference numerals will be used in the following description for elements identical to those of the first embodiment.

Figure 5:
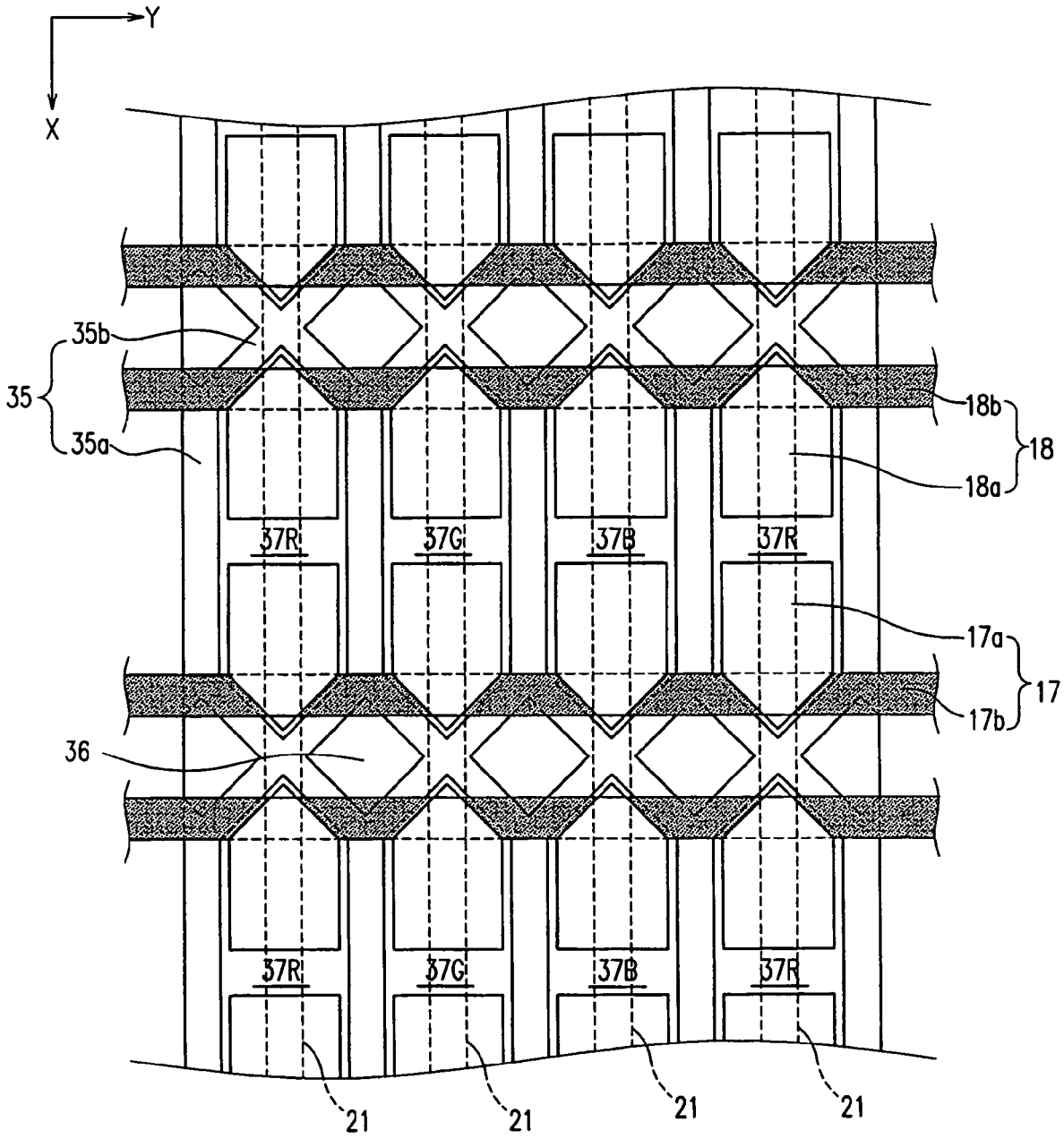
FIG. 5 is a partial plan view of a plasma display panel according to a second embodiment of the present invention.

FIG. 5 is a partial plan view of a plasma display panel according to a second embodiment of the present invention.

As shown in the drawing, in the PDP according to the second embodiment, a plurality of non-discharge regions 36 and a plurality of discharge cells 37R, 37G, and 37B are defined by barrier ribs 35. Non-discharge regions 36 are formed in areas encompassed by discharge cell abscissas and ordinates that pass through centers of each of the discharge cells 37R, 37G, and 37B, and that are aligned respectively with directions X and Y as in the first embodiment.

Ends of discharge cells 37R, 37G, and 37B are formed reducing in width in the direction of discharge sustain electrodes 17 and 18 (direction Y) as a distance from a center of each of the discharge cells 27R, 27G, and 27B is increased in the direction that address electrodes 21 are provided (direction X). Such a configuration is continued until reaching a point of minimal width such that the ends of discharge cells 37R, 37G, and 37B are wedge-shaped. Therefore, discharge cells 37R, 37G, and 37B have an overall planar shape of a hexagon.

Discharge sustain electrodes 17 and 18 include bus electrodes 17*b* and 18*b*, respectively, that are formed along a direction (direction Y) that is substantially perpendicular to the direction address electrodes 21 are formed (direction X), and protrusion electrodes 17*a* and 18*a*, respectively. For each row of discharge cells 37R, 37G, and 37B along direction Y, bus electrodes 17*b* are extended in the same direction overlapping one end of discharge cells 37R, 37G, and 37B, and bus electrodes 18*b* are extended overlapping an opposite end of discharge cells 37R, 37G, and 37B. Therefore, each of the discharge cells 37R, 37G, and 37B has one of the bus electrodes 17*b* positioned over one end, and one of the bus electrodes 18*b* positioned over its other end.

Further, for each row of discharge cells 37R, 37G, and 37B along direction Y, protrusion electrodes 17*a* overlap and protrude from corresponding bus electrode 17*b* into the area of discharge cells 37R, 37G, and 37B. Protrusion electrodes 18*a* overlap and protrude from corresponding bus electrode 18*b* into the area of discharge cells 37R, 37G, and 37B. Therefore, one protrusion electrode 17*a* and one protrusion electrode 18*a* are formed opposing one another in each area corresponding to each of the discharge cells 37R, 37G, and 37B.

Proximal ends of protrusion electrodes 17*a* and 18*a* (i.e., where protrusion electrodes 17*a* and 18*a* are attached to and extended from bus electrodes 17*b* and 18*b*, respectively) are formed corresponding to the wedge shape of the ends of discharge cells 37R, 37G, and 37B.

Figure 6:
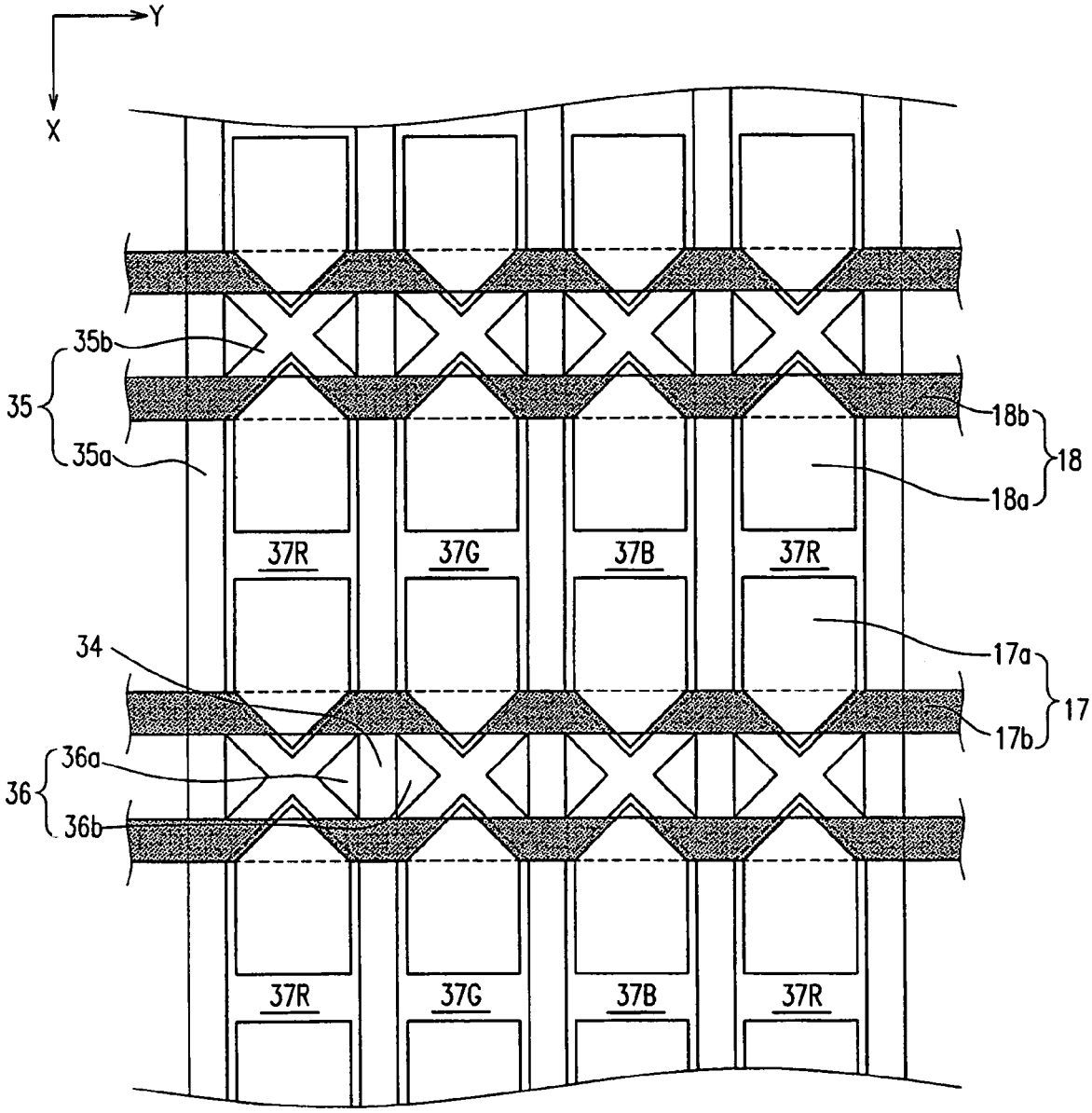
FIG. 6 is a partial plan view of a modified example of the plasma display panel of FIG. 5.

FIG. 6 is a partial plan view of a modified example of the plasma display panel of FIG. 5.

Partition barrier ribs 34 are formed in direction X passing through centers of non-discharge regions 36. Partition barrier ribs 34 may be formed by extending first barrier rib members 35*a* of barrier ribs 35. With the formation of partition barrier ribs 34, non-discharge regions 36 are divided into two sections 36*a* and 36*b*. It should be noted that non-discharge regions 36 may be divided into more than two sections depending on the number and formation of partition barrier ribs 34.

Figure 7:
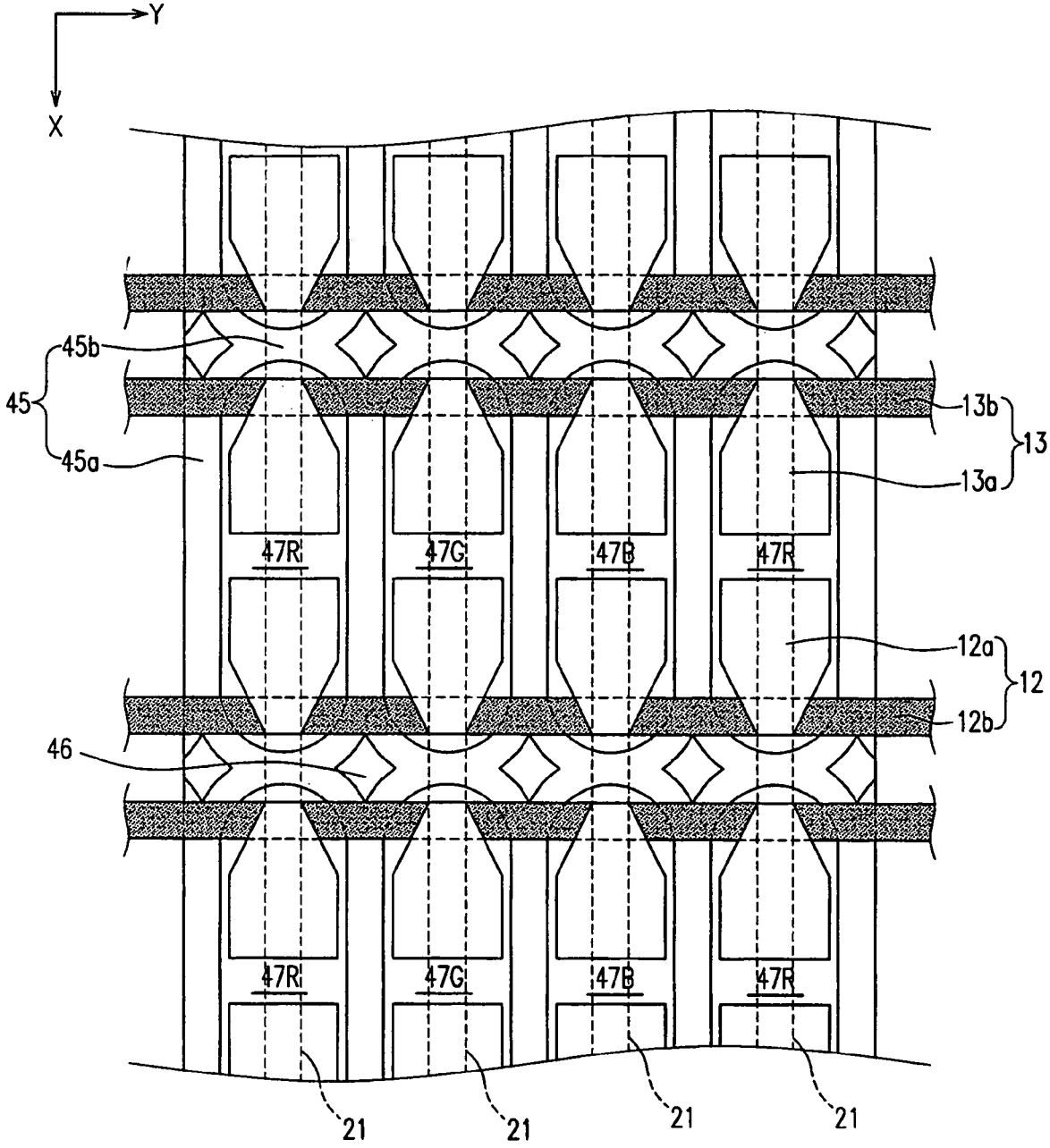
FIG. 7 is a partial plan view of a plasma display panel according to a third embodiment of the present invention.

FIG. 7 is a partial plan view of a plasma display panel according to a third embodiment of the present invention. As shown in the drawing, in the PDP according to the third embodiment, a plurality of non-discharge regions 46 and a plurality of discharge cells 47R, 47G, and 47B are defined by barrier ribs 45. Non-discharge regions 46 are formed in areas encompassed by discharge cell abscissas and ordinates that pass through centers of each of the discharge cells 47R, 47G, and 47B, and that are aligned respectively with directions X and Y as in the first embodiment. With lengths of discharge cells 47R, 47G, and 47B being provided along a direction of address electrodes 21 (direction X), ends of discharge cells 47R, 47G, and 47B are rounded into an arc shape.

Discharge sustain electrodes 12 and 13 include bus electrodes 12*b* and 13*b*, respectively, that are formed along a direction (direction Y) that is substantially perpendicular to the direction address electrodes 21 are formed (direction X), and protrusion electrodes 12*a* and 13*a*, respectively. For each row of discharge cells 47R, 47G, and 47B along direction Y, bus electrodes 12*b* are extended in the same direction overlapping one end of discharge cells 47R, 47G, and 47B, and bus electrodes 13*b* are extended overlapping an opposite end of discharge cells 47R, 47G, and 47B. Therefore, each of the discharge cells 47R, 47G, and 47B has one of the bus electrodes 12*b* positioned over one end, and one of the bus electrodes 13*b* positioned over its other end.

Further, for each row of discharge cells 47R, 47G, and 47B along direction Y, protrusion electrodes 12*a* overlap and protrude from corresponding bus electrode 12*b* into the area of discharge cells 47R, 47G, and 47B Also, protrusion electrodes 13*a* overlap and protrude from corresponding bus electrode 13*b* into the area of discharge cells 47R, 47G, and 47B. Therefore, one protrusion electrode 12*a* and one protrusion electrode 13*a* are formed opposing one another in each area corresponding to each of the discharge cells 47R, 47G, and 47B.

Proximal ends of protrusion electrodes 12*a* and 13*a* (i.e., where protrusion electrodes 12*a* and 13*a* are attached to and extended from bus electrodes 12*b* and 13*b*, respectively) are formed in a wedge-shape configuration. That is, the proximal ends of protrusion electrodes 12*a* and 13*a* reduce in width along direction Y as the distance from the center of discharge cells 47R, 47G, and 47B along direction X is increased to thereby realize their wedge shape.

Figure 8:
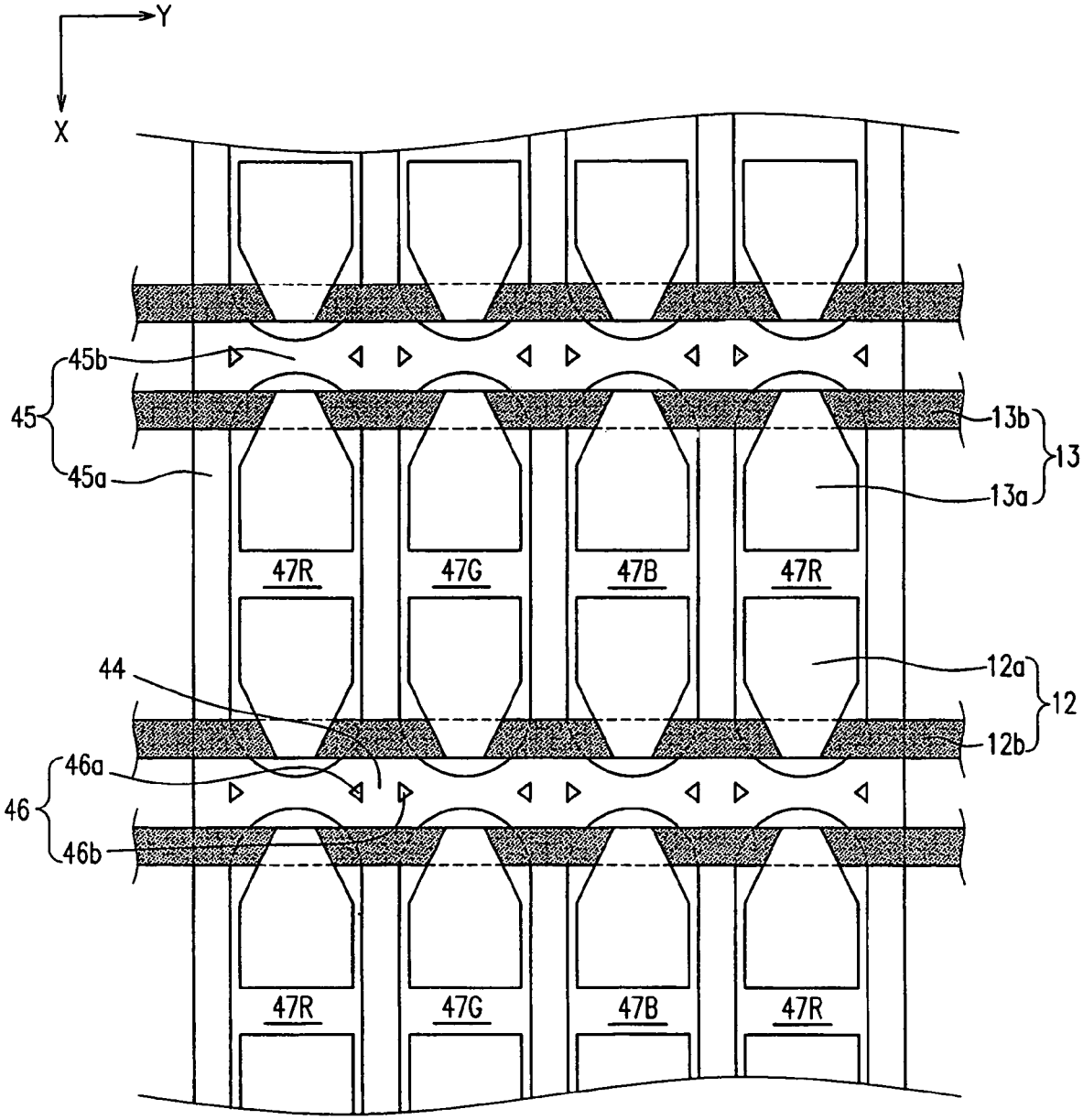
FIG. 8 is a partial plan view of a modified example of the plasma display panel of FIG. 7.

FIG. 8 is a partial plan view of a modified example of the plasma display panel of FIG. 7. Partition barrier ribs 44 are formed in direction X passing through centers of non-discharge regions 46. Partition barrier ribs 44 may be formed by extending first barrier rib members 45*a* of barrier ribs 45. With the formation of partition barrier ribs 44, non-discharge regions 46 are divided into two sections 46*a* and 46*b*. It should be noted that non-discharge regions 46 may be divided into more than two sections depending on the number and formation of partition barrier ribs 44.

Figure 9:
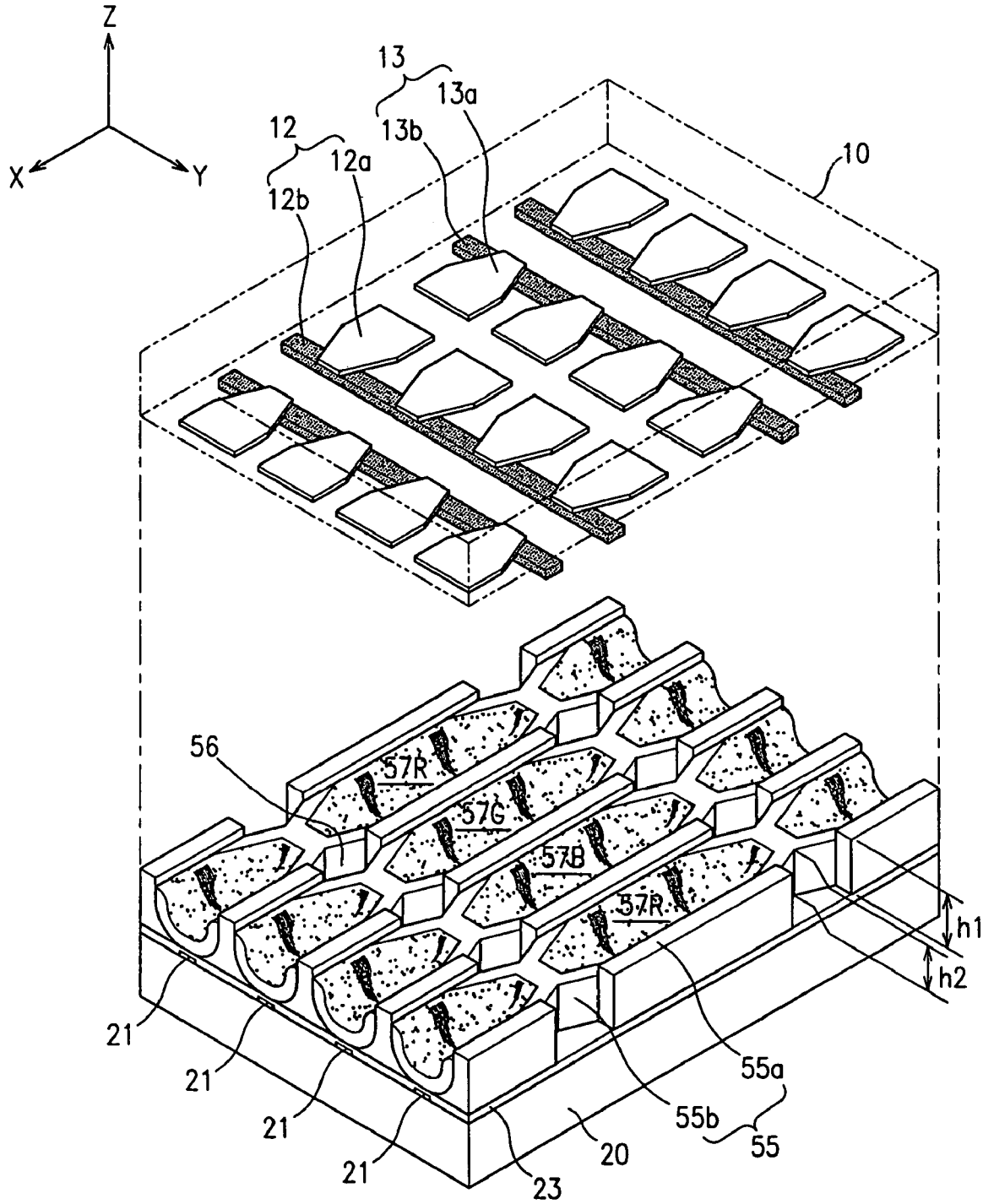
FIG. 9 is a partial exploded perspective view of a plasma display panel according to a fourth embodiment of the present invention.
Figure 10:
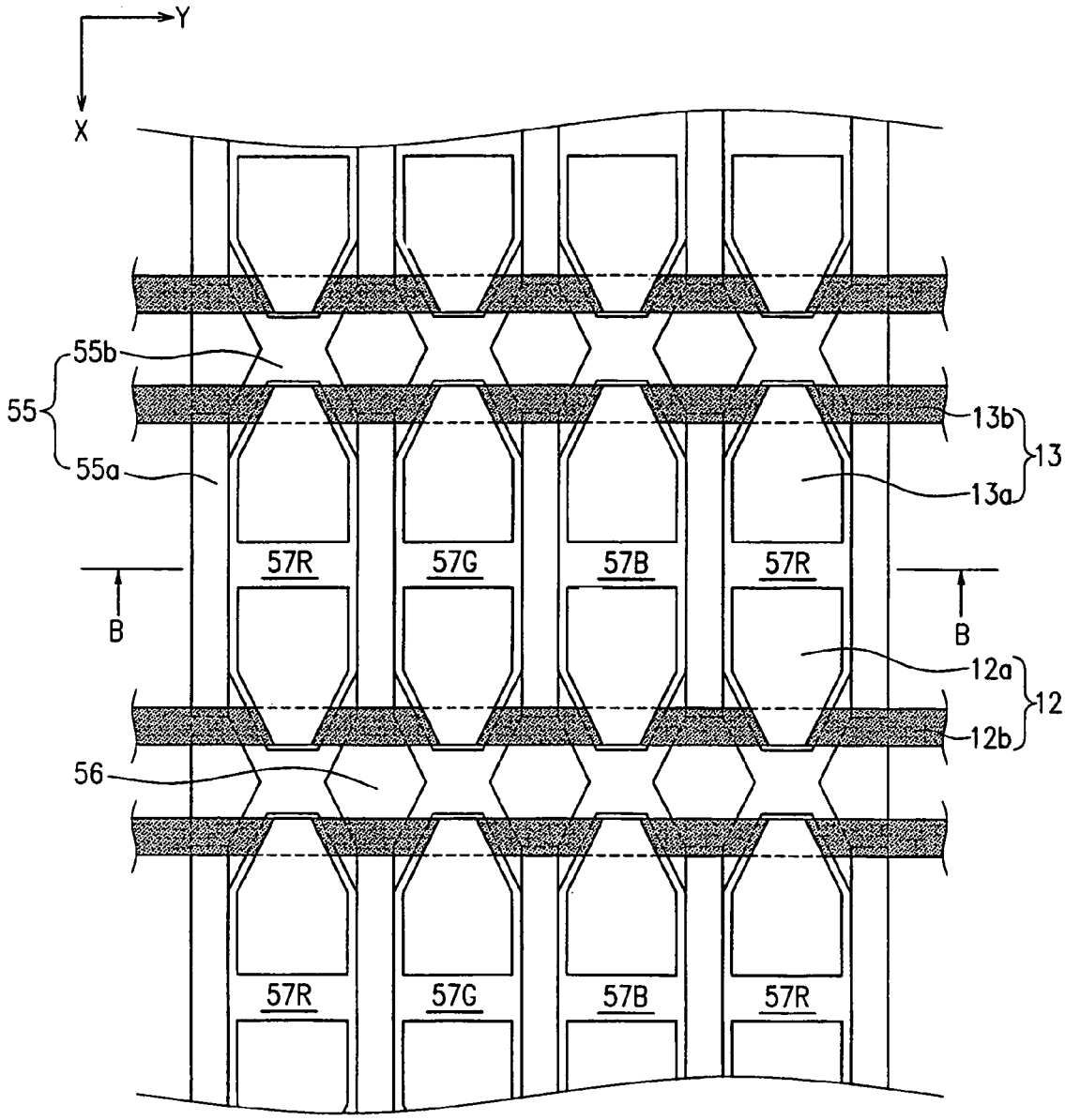
FIG. 10 is a partial plan view of the plasma display panel of FIG. 9.
Figure 11:
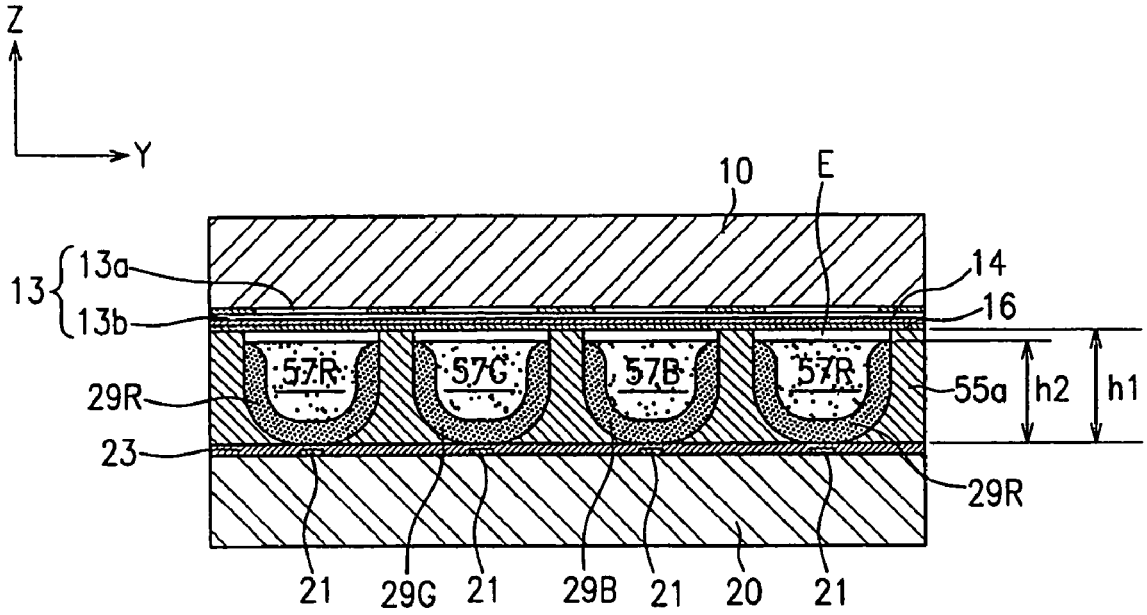
FIG. 11 is a sectional view taken along line B-B of FIG. 10.

FIG. 9 is a sectional exploded perspective view of a plasma display panel according to a fourth embodiment of the present invention, FIG. 10 is a partial plan view of the plasma display panel of FIG. 9, and FIG. 11 is a sectional view taken along line B-B of FIG. 10. In the plasma display panel (PDP) according to the fourth embodiment, barrier ribs 55 that define non-discharge regions 56 and discharge cells 57R, 57G, and 57B include first barrier rib members 55*a* that are parallel to address electrodes 21, and second barrier rib members 55*b* that define ends of discharge cells 57R, 57G, and 57B, are not parallel to address electrodes 21, and intersect over address electrodes 21. Second barrier rib members 55*b* are formed in substantially an X shape between discharge cells 57R, 57G, and 57B that are adjacent in the direction the address electrodes are formed (direction X). Each of the non-discharge regions 56 is defined by a pair of second barrier rib members 55*b* adjacent in the direction discharge sustain electrodes 12 and 13 are formed (direction Y), and by a pair of first barrier rib members 55*a* adjacent in the direction address electrodes 21 are formed (direction X). Non-discharge regions 56 are therefore formed into independent cell structures.

Further, first barrier rib members 55*a* and second barrier rib members 55*b* forming barrier ribs 55 may have different heights. In the fourth embodiment, height h1 of first barrier rib members 55*a* is greater than a height h2 of second barrier rib members 55*b*. As a result, with reference to FIG. 11, exhaust spaces E are formed between first substrate 10 and second substrate 20 to thereby enable more effective and smoother evacuation of the PDP during manufacture. It is also possible for height h1 of first barrier rib members 55*a* to be less than height h2 of second barrier rib members 55*b*.

All other aspects of the fourth embodiment such as the shape of discharge cells 57R, 57G, and 57B, and/or of discharge sustain electrodes 12 and 13, and the positioning of discharge cells 57R, 57G, and 57B relative to non-discharge regions 56 are identical to the first embodiment.

Figure 12:
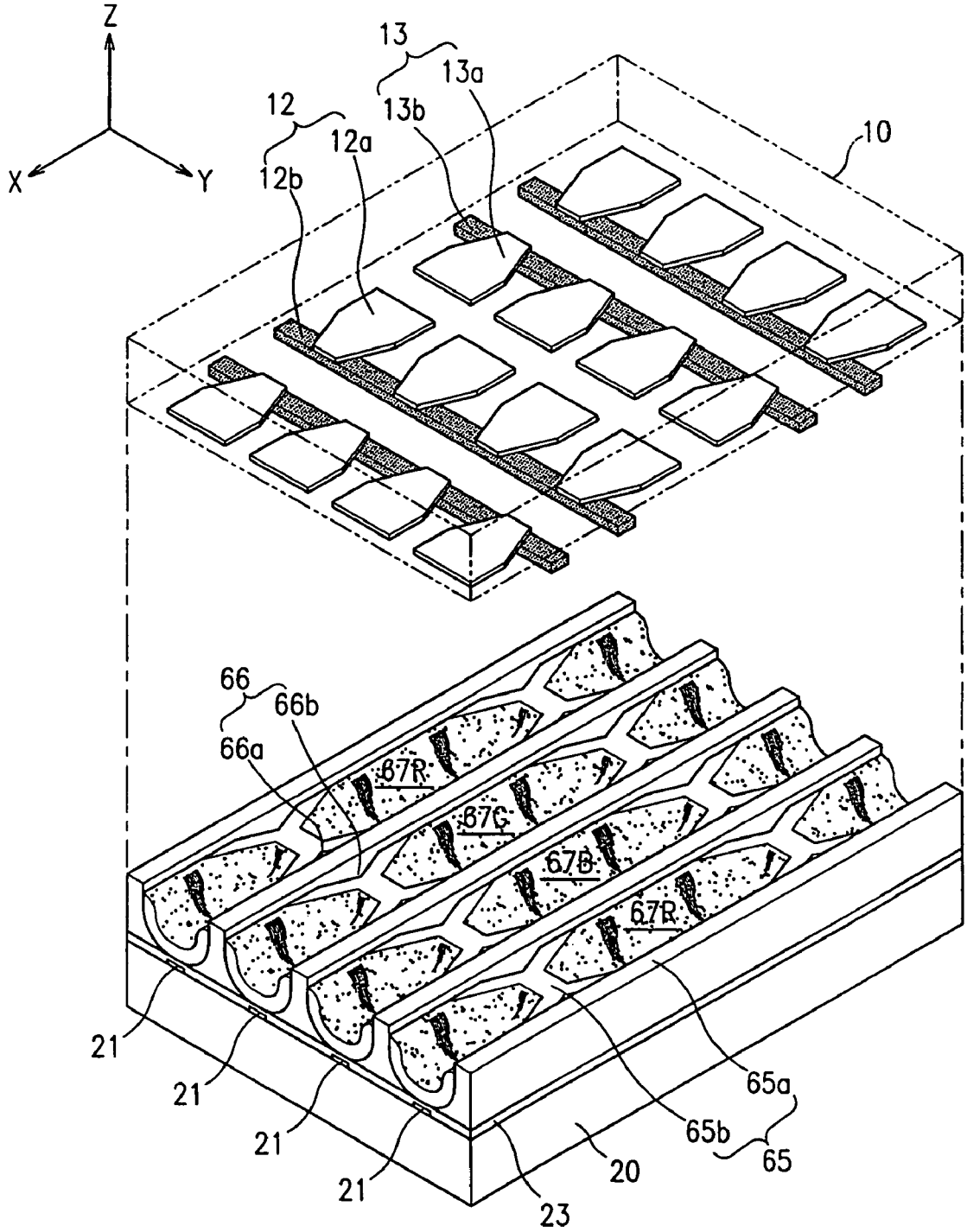
FIG. 12 is a partial exploded perspective view of a plasma display panel according to a fifth embodiment of the present invention.

FIG. 12 is a sectional exploded perspective view of a plasma display panel according to a fifth embodiment of the present invention. In the plasma display panel (PDP) according to the fifth embodiment, barrier ribs 65 that define non-discharge regions 66 and discharge cells 67R, 67G, and 67B include first barrier rib members 65*a* that are parallel to address electrodes 21, and second barrier rib members 65*b* that define ends of discharge cells 67R, 67G, and 67B, are not parallel to address electrodes 21, and intersect over address electrodes 21. First barrier rib members 65*a* are formed in a striped pattern in the direction address electrodes 21 are formed, and each extends a length of the PDP in the same direction. Second barrier rib members 65*b* are formed in substantially an X shape between discharge cells 67R, 67G, and 67B that are adjacent in the direction the address electrodes are formed (direction X). Each of the non-discharge regions 66, including sections 66*a* and 66*b*, is defined by a pair of second barrier rib members 65*b* adjacent in the direction discharge sustain electrodes 12 and 13 are formed (direction Y), and by one of the first barrier rib members 65*a*, which pass through centers of non-discharge regions 66 in the direction address electrodes 21 are formed (direction X).

Further, first barrier rib members 65*a* and second barrier rib members 65*b* forming barrier ribs 65 may have different heights. In the fifth embodiment, a height of first barrier rib members 65*a* is greater than a height of second barrier rib members 65*b*. This allows for more effective and smoother evacuation of the PDP during manufacture. It is also possible for the height of first barrier rib members 65*a* to be less than the height of second barrier rib members 65*b*.

All other aspects of the fifth embodiment such as the shape of discharge cells 67R, 67G, and 67B, and/or of discharge sustain electrodes 12 and 13, and the positioning of discharge cells 67R, 67G, and 67B relative to non-discharge regions 66 are identical to the first embodiment.

Figure 13:
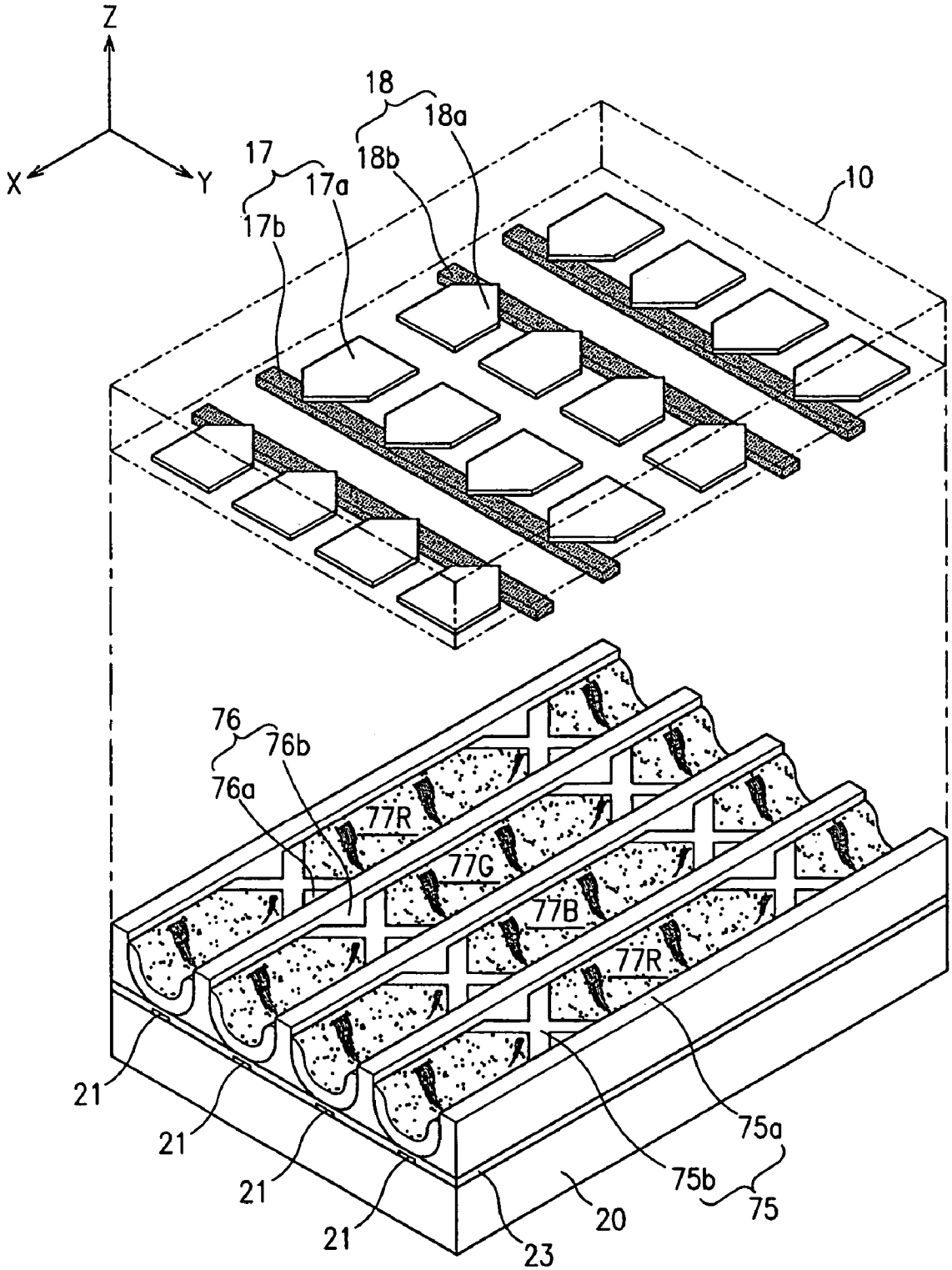
FIG. 13 is a partial exploded perspective view of a plasma display panel according to a sixth embodiment of the present invention.

FIG. 13 is a sectional exploded perspective view of a plasma display panel according to a sixth embodiment of the present invention. In the plasma display panel (PDP) according to the sixth embodiment, barrier ribs 75 that define non-discharge regions 76 and discharge cells 77R, 77G, and 77B include first barrier rib members 75*a* that are parallel to address electrodes 21, and second barrier rib members 75*b* that define ends of discharge cells 77R, 77G, and 77B, are not parallel to address electrodes 21, and intersect over address electrodes 21. First barrier rib members 75*a* are formed in a striped pattern in the direction address electrodes 21 are formed, and each extends a length of the PDP in the same direction. Second barrier rib members 75*b* are formed in substantially an X shape between discharge cells 77R, 77G, and 77B that are adjacent in the direction the address electrodes are formed (direction X). Each of the non-discharge regions 76 is defined by a pair of second barrier rib members 75*b* adjacent in the direction discharge sustain electrodes 12 and 13 are formed (direction Y), and by one of the first barrier rib members 75*a*, which pass through centers of non-discharge regions 76 in the direction address electrodes 21 are formed (direction X).

Further, first barrier rib members 75*a* and second barrier rib members 75*b* forming barrier ribs 75 may be formed have different heights. In the sixth embodiment, a height of first barrier rib members 75*a* is greater than a height of second barrier rib members 75*b*. This allows for more effective and smoother evacuation of the PDP during manufacture. It is also possible for the height of first barrier rib members 75*a* to be less than the height of second barrier rib members 75*b*.

All other aspects of the sixth embodiment such as the shape of discharge cells 77R, 77G, and 77B, and/or of discharge sustain electrodes 12 and 13, and the positioning of discharge cells 77R, 77G, and 77B relative to non-discharge regions 76 are identical to the second embodiment.

Figure 14:
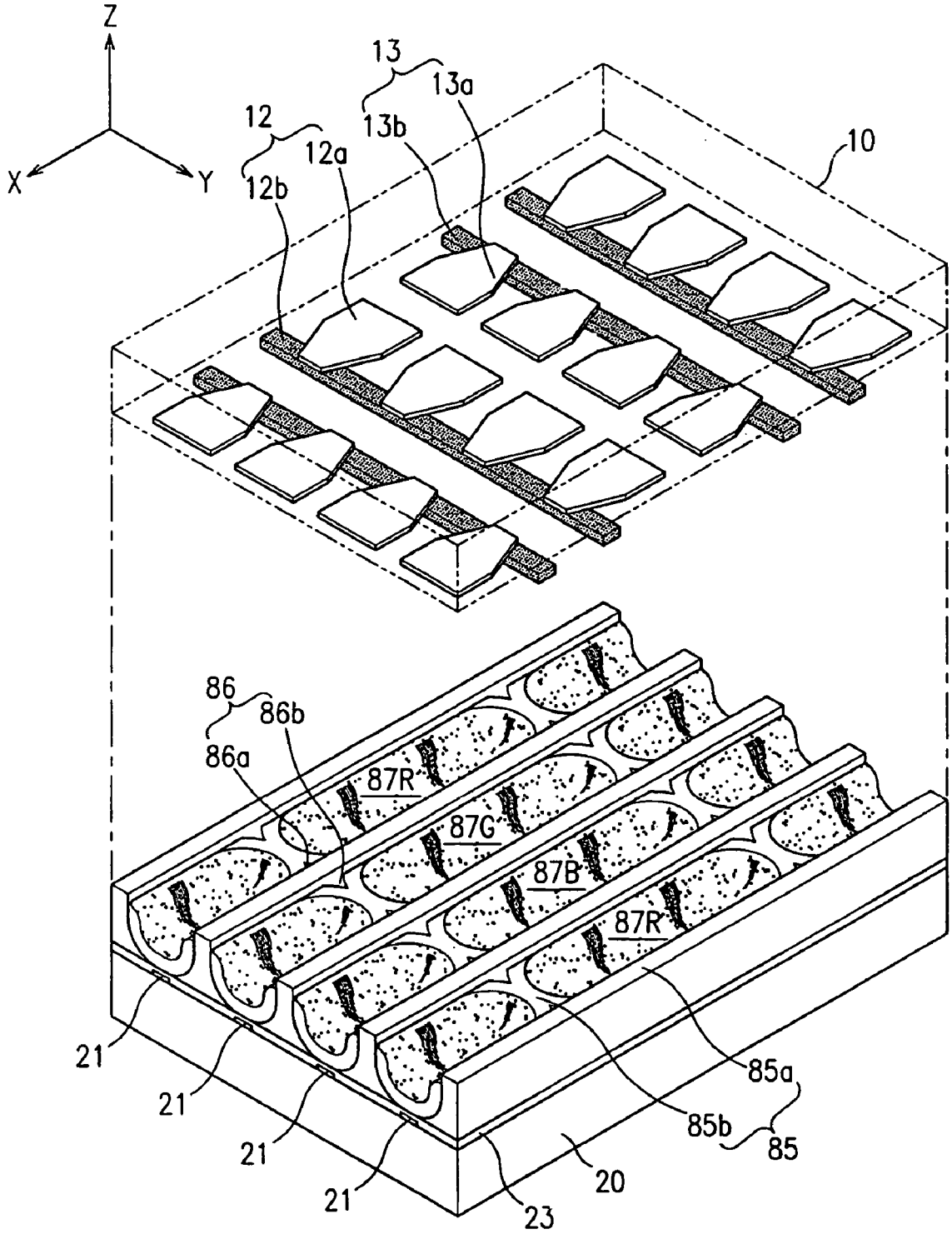
FIG. 14 is a partial exploded perspective view of a plasma display panel according to a seventh embodiment of the present invention.

FIG. 14 is a sectional exploded perspective view of a plasma display panel according to a seventh embodiment of the present invention. In the plasma display panel (PDP) according to the seventh embodiment, barrier ribs 85 that define non-discharge regions 86, including sections 86*a* and 86*b*, and discharge cells 87R, 87G, and 87B include first barrier rib members 85*a* that are parallel to address electrodes 21, and second barrier rib members 85*b* that define ends of discharge cells 87R, 87G, and 87B, are not parallel to address electrodes 21, and intersect over address electrodes 21. First barrier rib members 85*a* are formed in a striped pattern in the direction address electrodes 21 are formed, and each extends a length of the PDP in the same direction. Second barrier rib members 85*b* are formed in substantially an X shape between discharge cells 87R, 87G, and 87B that are adjacent in the direction the address electrodes are formed (direction X). Each of the non-discharge regions 86 is defined by a pair of second barrier rib members 85*b* adjacent in the direction discharge sustain electrodes 12 and 13 are formed (direction Y), and by one of the first barrier rib members 85*a*, which pass through centers of non-discharge regions 86 in the direction address electrodes 21 are formed (direction X).

Further, first barrier rib members 85*a* and second barrier rib members 85*b* forming barrier ribs 85 may have different heights. In the seventh embodiment, a height of first barrier rib members 85*a* is greater than a height of second barrier rib members 85*b*. This allows for more effective and smoother evacuation of the PDP during manufacture. It is also possible for the height of first barrier rib members 85*a* to be less than the height of second barrier rib members 85*b*.

All other aspects of the seventh embodiment such as the shape of discharge cells 87R, 87G, and 87B, and/or of discharge sustain electrodes 12 and 13, and the positioning of discharge cells 87R, 87G, and 87B relative to non-discharge regions 86 are identical to the third embodiment.

Figure 15:
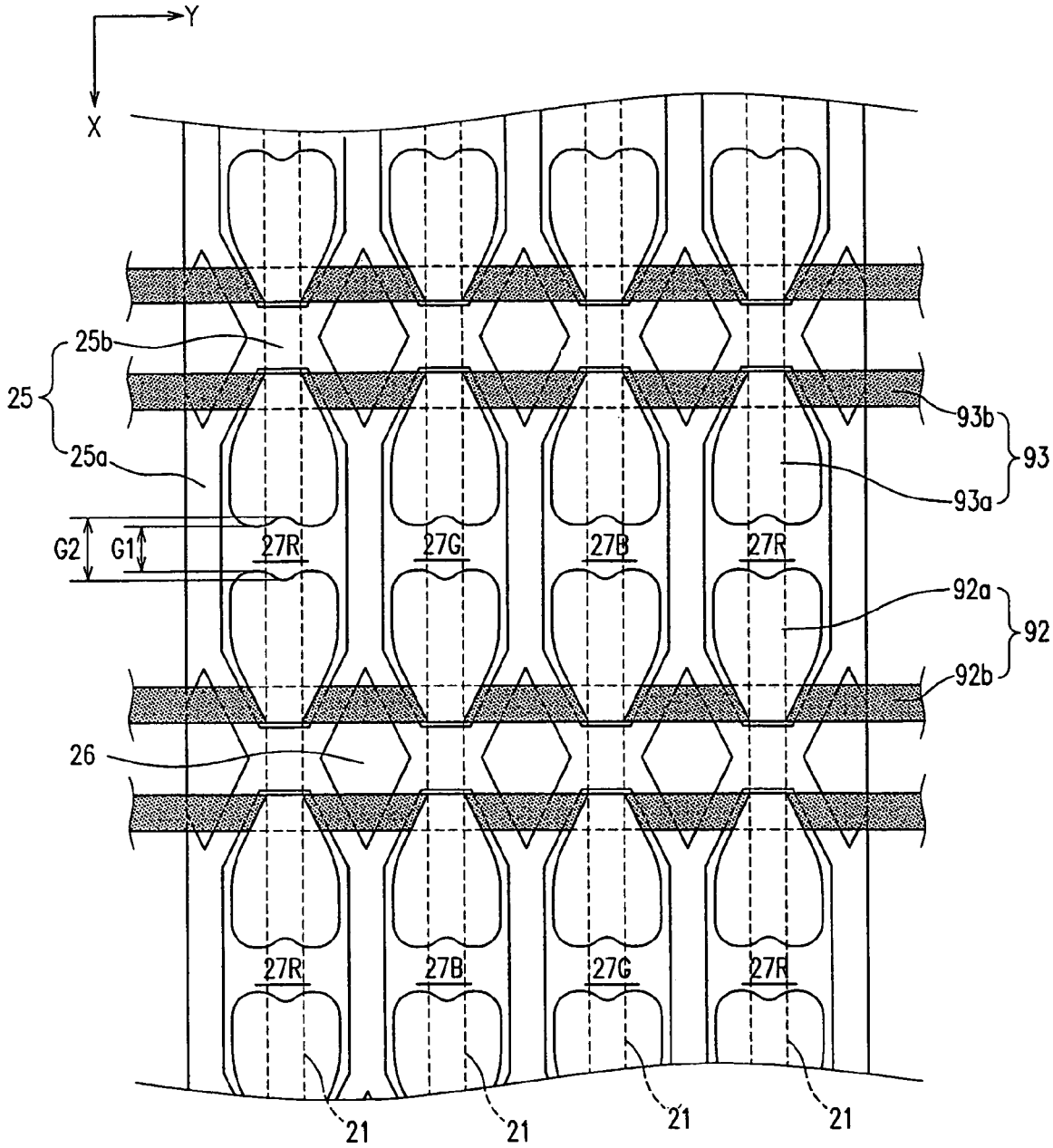
FIG. 15 is a partial plan view of a plasma display panel according to an eighth embodiment of the present invention.

FIG. 15 is a sectional exploded perspective view of a plasma display panel according to an eighth embodiment of the present invention. In the plasma display panel (PDP) according to the eighth embodiment, discharge sustain electrodes 92 and 93 respectively include bus electrodes 92*b* and 93*b* that are formed along a direction substantially perpendicular to a direction address electrodes 21 are formed, and respectively include protrusion electrodes 92*a* and 93*a* that extend from bus electrodes 92*b* and 93*b*, respectively, into areas corresponding to discharge cells 27R, 27G, and 27B.

Distal ends of protrusion electrodes 92*a* and 93*a* are formed such that center areas along direction Y are indented and sections to both sides of the indentations are protruded. Therefore, in each of the discharge cells 27R, 27G, and 27B, first discharge gap G1 and second discharge gap G2 of different sizes are formed between opposing protrusion electrodes 92*a* and 93*a*. That is, second discharge gaps G2 (or long gaps) are formed where the indentations of protrusion electrodes 92*a* and 93*a* oppose one another, and first discharge gaps G1 (or short gaps) are formed where the protruded areas to both sides of the indentations of protrusion electrodes 92*a* and 93*a* oppose one another. Accordingly, plasma discharge, which initially occurs at center areas of discharge cells 27R, 27G, and 27B, is more efficiently diffused such that overall discharge efficiency is increased. The distal ends of protrusion electrodes 92*a* and 93*a* may be formed with only indented center areas such that protruded sections are formed to both sides of the indentations, or may be formed with the protrusions to both sides of the indentations extending past a reference straight line r formed along direction Y. Further, protrusion electrodes 92*a* and 93*a* providing the pair of the same positioned within each of the discharge cells 27R, 27G, and 27B may be formed as described above, or only one of the pair may be formed with the indentations and protrusions. Regardless of the particular configuration used, in one embodiment edges of the indentations and protrusions of protrusion electrodes 92*a* and 93*a* are rounded with no abrupt changes in angle.

All other aspects of the eighth embodiment such as the shape of discharge cells 27R, 27G, and 27B, and the positioning of discharge cells 27R, 27G, and 27B relative to non-discharge regions 26 are identical to the first embodiment.

Discharge sustain electrodes 92 and 93 are positioned with first and second gaps G1 and G2 interposed therebetween to thereby reduce a discharge initialization voltage Vf. Accordingly, in the eighth embodiment, the amount of Xe contained in the discharge gas may be increased and the discharge initialization voltage Vf may be left at the same level. The discharge gas contains 10% or more Xe. In one embodiment, the discharge gas contains 10~60% Xe. With the increased Xe content, vacuum ultraviolet rays may be emitted with a greater intensity to thereby enhance screen brightness.

The relation between the Xe content in discharge gas and first and second gaps G1 and G2 will be described with reference to Table 1 below and FIG. 16.

In Table 1, with A established as the sum of a size of gap G1 and a size of gap G2, there are shown results obtained through experimentation of different A values in which driving is possible with a suitable discharge initialization voltage Vf depending on changes in the Xe content. It is to be noted that satisfactory driving of the PDP was not possible when the discharge gas contained 60% or more Xe.

In Table 1 below, F(A+Xe) is the sum of the A values with the Xe content values. That is, the A values were simply added to the Xe values and no conversion in the units of micrometers for the A values and the units of percentage for the Xe content values were made before the addition operations. Further, the discharge efficiencies measured for the different Xe content values in the discharge gas are based on a value of 1 for the discharge efficiency obtained when the discharge gas contains 5% Xe.

TABLE 1

| Xe content (%) in discharge gas | Suitable A values (μm) according to XE content | F(A + Xe) | Discharge efficiency |
|---|---|---|---|
| 5 | 180~210 | 185~215 | 1 |
| 7 | 170~210 | 177~217 | 1.05 |
| 10 | 165~210 | 175~220 | 1.35 |
| 15 | 155~195 | 170~210 | 1.45 |
| 20 | 147~190 | 167~210 | 1.57 |
| 25 | 143~187 | 168~213 | 1.76 |
| 30 | 137~187 | 167~217 | 2.0 |
| 35 | 135~185 | 170~220 | 2.26 |
| 40 | 133~185 | 173~225 | 2.41 |
| 50 | 125~180 | 175~230 | 2.89 |
| 55 | 120~177 | 175~232 | 3.12 |
| 60 | 110~170 | 170~240 | 3.48 |

As shown in Table 1, when the size of first and second discharge gaps G1 and G2 is reduced as the Xe content in the discharge gas is increased from 5% to 60%, driving of the PDP is possible with a suitable discharge initialization voltage Vf and discharge efficiency is improved. In particular, when the instances in which the Xe content is 10% or more are compared to when it is 5%, it is clear that a significant improvement in discharge efficiency is realized. Accordingly, the PDP of the eighth embodiment realizes an increase in discharge efficiency by the formation of the protrusion electrodes as described above and by the Xe content of 10% to 60% in the discharge gas.

Figure 16:
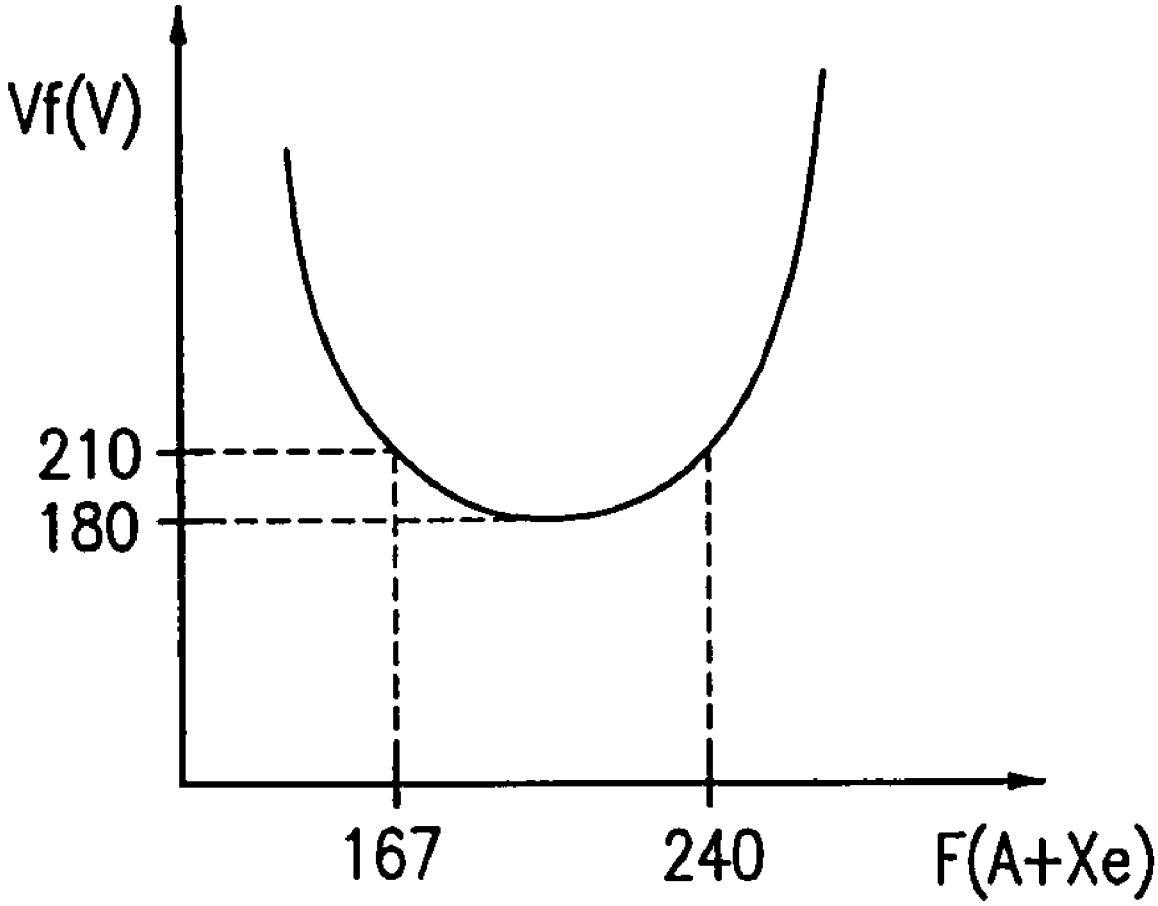
FIG. 16 is a graph showing changes in a discharge initialization voltage as a function of F(A+Xe).

FIG. 16 is a graph showing changes in the discharge initialization voltage Vf as a function of F(A+Xe).

When the Xe content is between 10 and 60% and the F(A+Xe) value is in the range of 167~240, driving occurs in the range of 180~210V. In the PDP field, this is considered to be an appropriate drive voltage range. Accordingly, the PDP of the eighth embodiment includes discharge gas that contains 10~60% Xe and a discharge sustain electrode formation in which the F(A+Xe) value is in the range of 167~240.

Figure 17:
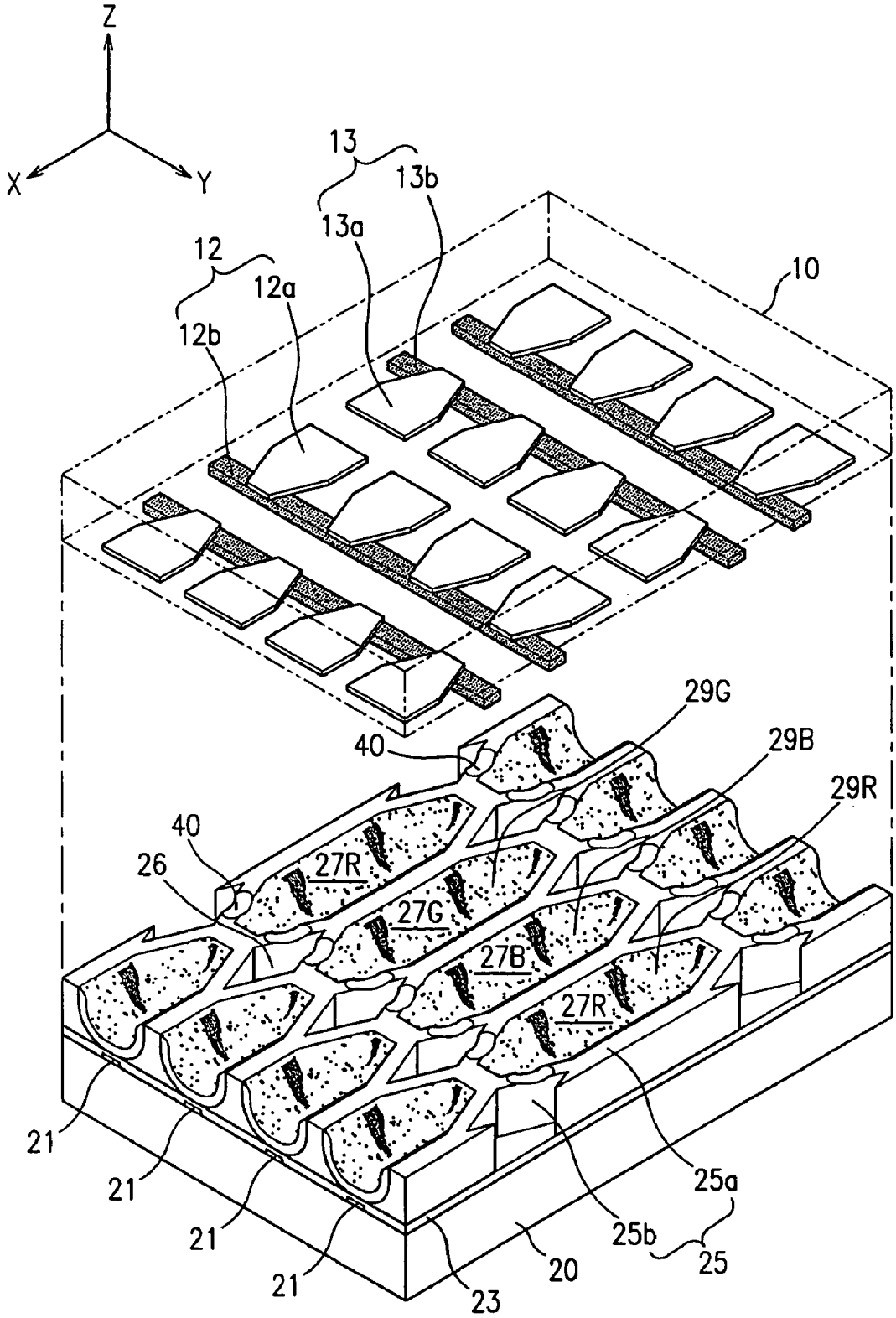
FIG. 17 is a partial exploded perspective view of a plasma display panel according to a ninth embodiment of the present invention.
Figure 18:
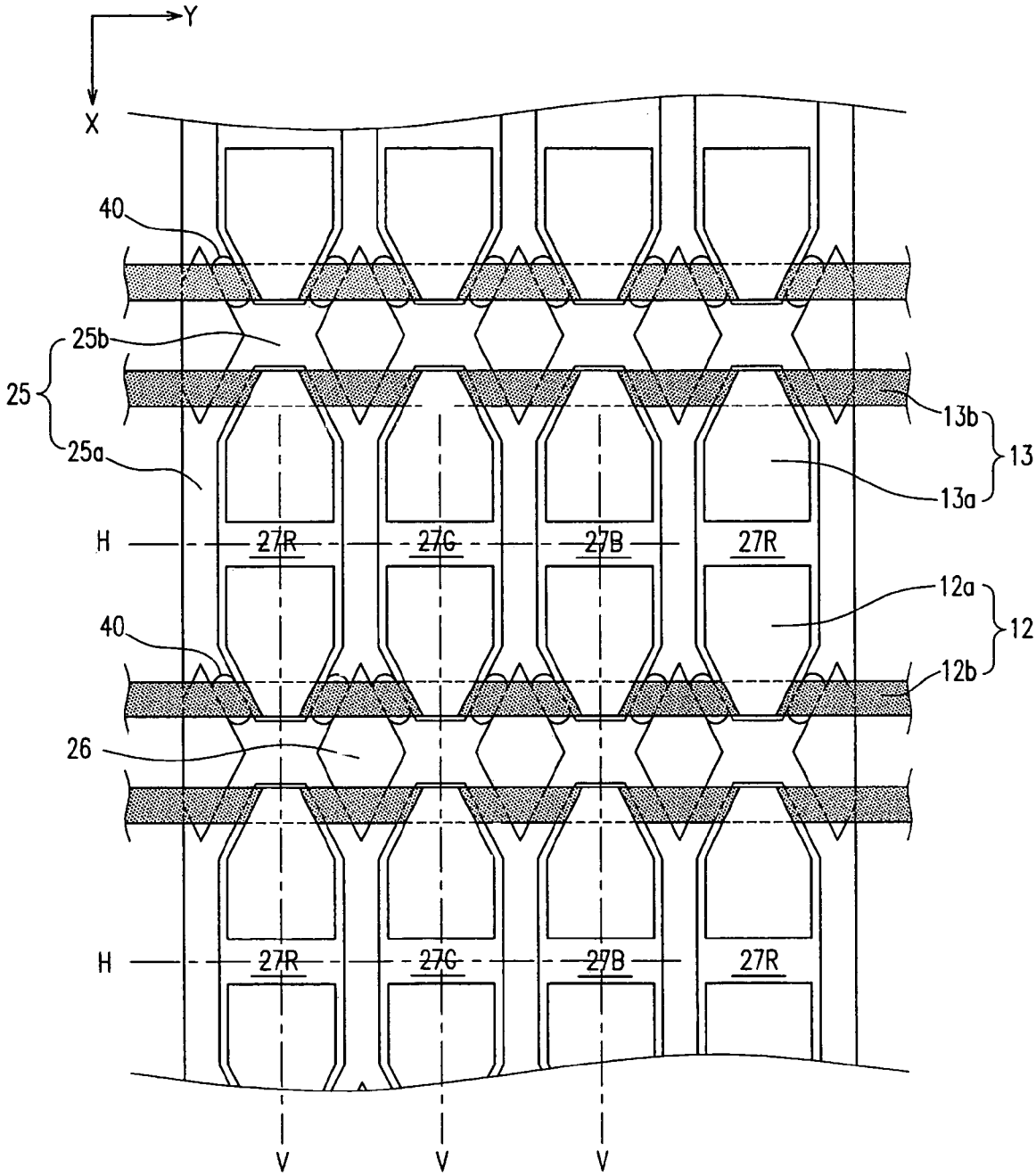
FIG. 18 is a partial plan view of the plasma display panel of FIG. 17.

FIG. 17 is a partial exploded perspective view of a plasma display panel according to a ninth embodiment of the present invention, and FIG. 18 is a partial plan view of the plasma display panel of FIG. 17.

In the plasma display panel (PDP) according to the ninth embodiment, barrier ribs 25 that define non-discharge regions 26 and discharge cells 27R, 27G, and 27B include first barrier rib members 25*a* that are parallel to address electrodes 21, and second barrier rib members 25*b* that define ends of discharge cells 27R, 27G, and 27B, are not parallel to address electrodes 21, and intersect over address electrodes 21.

Ventilation paths 40 are formed on second barrier rib members 25*b*. Ventilation paths 40 allow for more effective and smoother evacuation of the PDP during manufacture. Further, ventilation paths 40 are formed as grooves on second barrier rib members 25*b* such that non-discharge regions 26 and discharge cells 27R, 27G, and 27B are in communication.

Figure 19A:
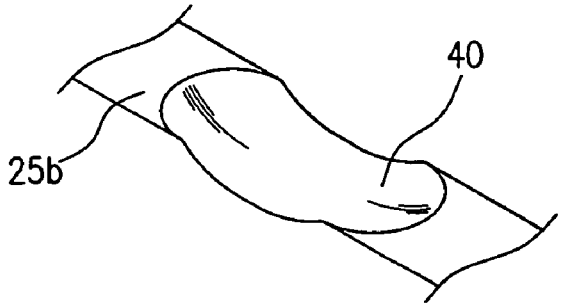
FIGS. 19A and 19B are respectively a perspective view and a plan view of a ventilation path of the plasma display panel of FIG. 17.
Figure 19B:
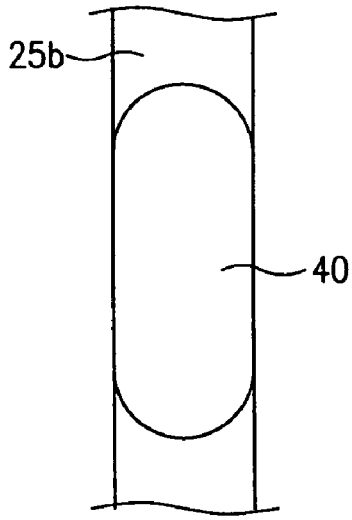
Figure 20A:
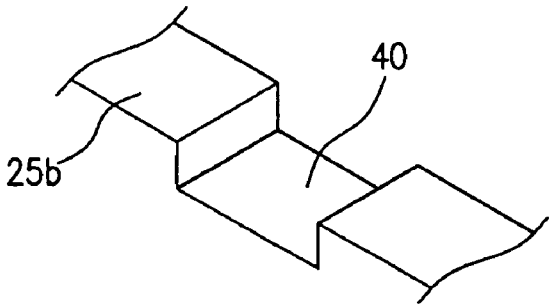
FIGS. 20A and 20B are respectively a perspective view and a plan view of a modified example of a ventilation path shown in FIGS. 19A and 19B.
Figure 20B:
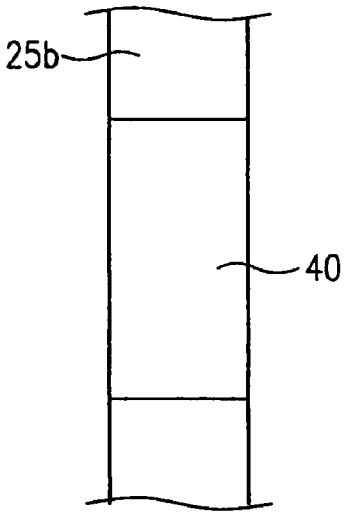

When viewed from above, the grooves forming ventilation paths 40 may be substantially elliptical as shown in FIGS. 19A and 19B, or may be substantially rectangular as shown in FIGS. 20A and 20B. However, the grooves are not limited to any one shape and may be formed in a variety of ways as long as there is communication between non-discharge regions 26 and discharge cells 27R, 27G, and 27B.

In the PDP having ventilation paths 40 as described above, air in the PDP including air in discharge cells 27R, 27G, and 27B may be easily evacuated to thereby result in a more complete vacuum state within the PDP. Further, although a pair of ventilation paths 40 is shown in FIG. 18 as being formed for each of the discharge cells 27R, 27G, and 27B, a greater or lesser number of ventilation paths 40 may be formed as needed.

Ventilation paths 40 may be applied to PDPs having various barrier rib structures based on the structure of the first embodiment.

Figure 21:
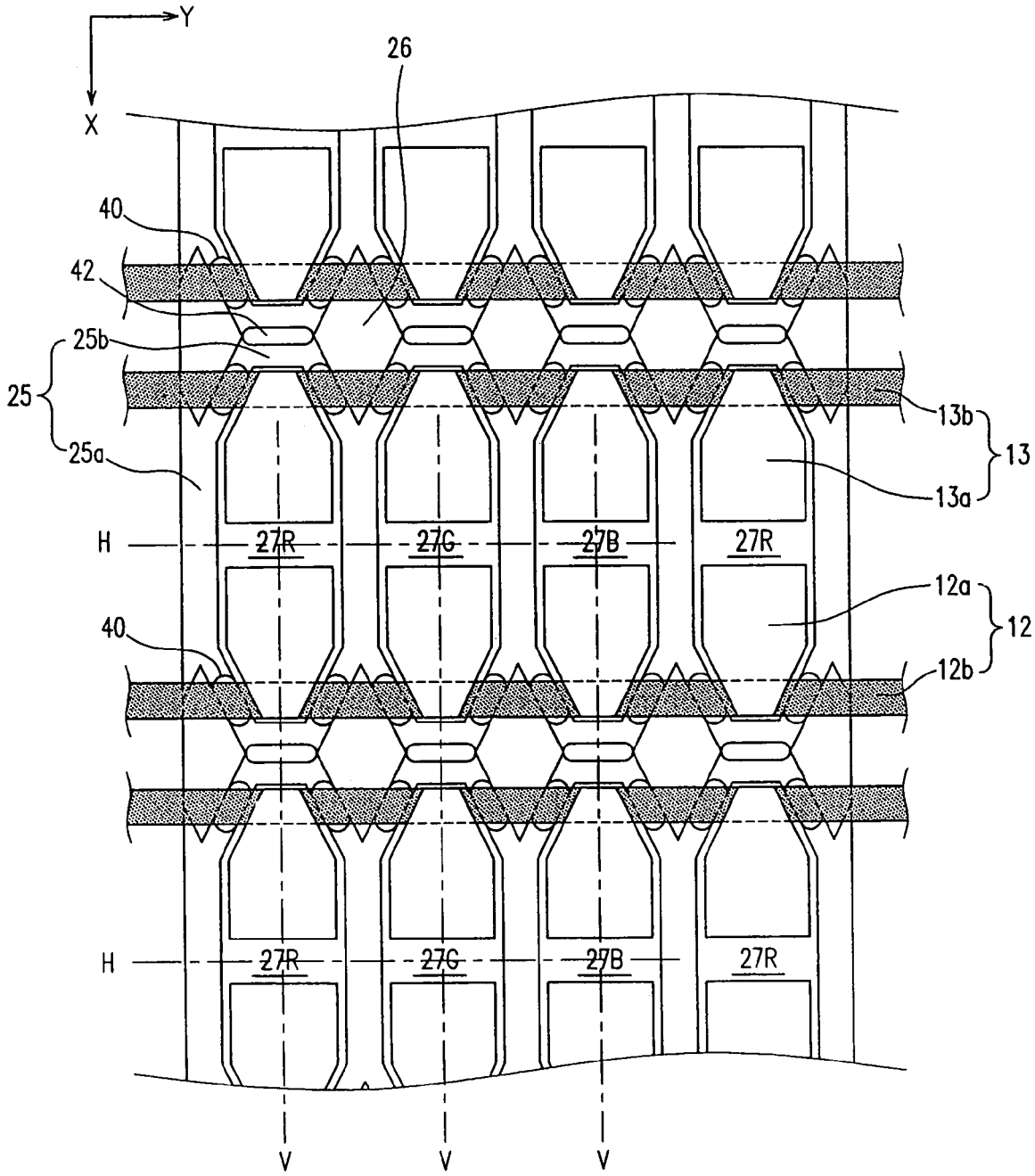
FIG. 21 is a partial plan view of a modified example of the plasma display panel of FIG. 17.

FIG. 21 is a partial plan view of a modified example of the plasma display panel of FIG. 17.

Auxiliary ventilation paths 42 are formed on second barrier rib members 25*b* that define non-discharge regions 26. Auxiliary ventilation paths 42 communicate non-discharge regions 26 adjacent along direction Y. Further, auxiliary ventilation paths 42 further enable easy evacuation of the PDP during manufacture. Auxiliary ventilation paths 42 may be substantially elliptical or rectangular when viewed from above as with ventilation paths 40.

Auxiliary ventilation paths 42 may be applied to various barrier rib structures in addition to the barrier rib structure shown in FIG. 21.

Figure 22:
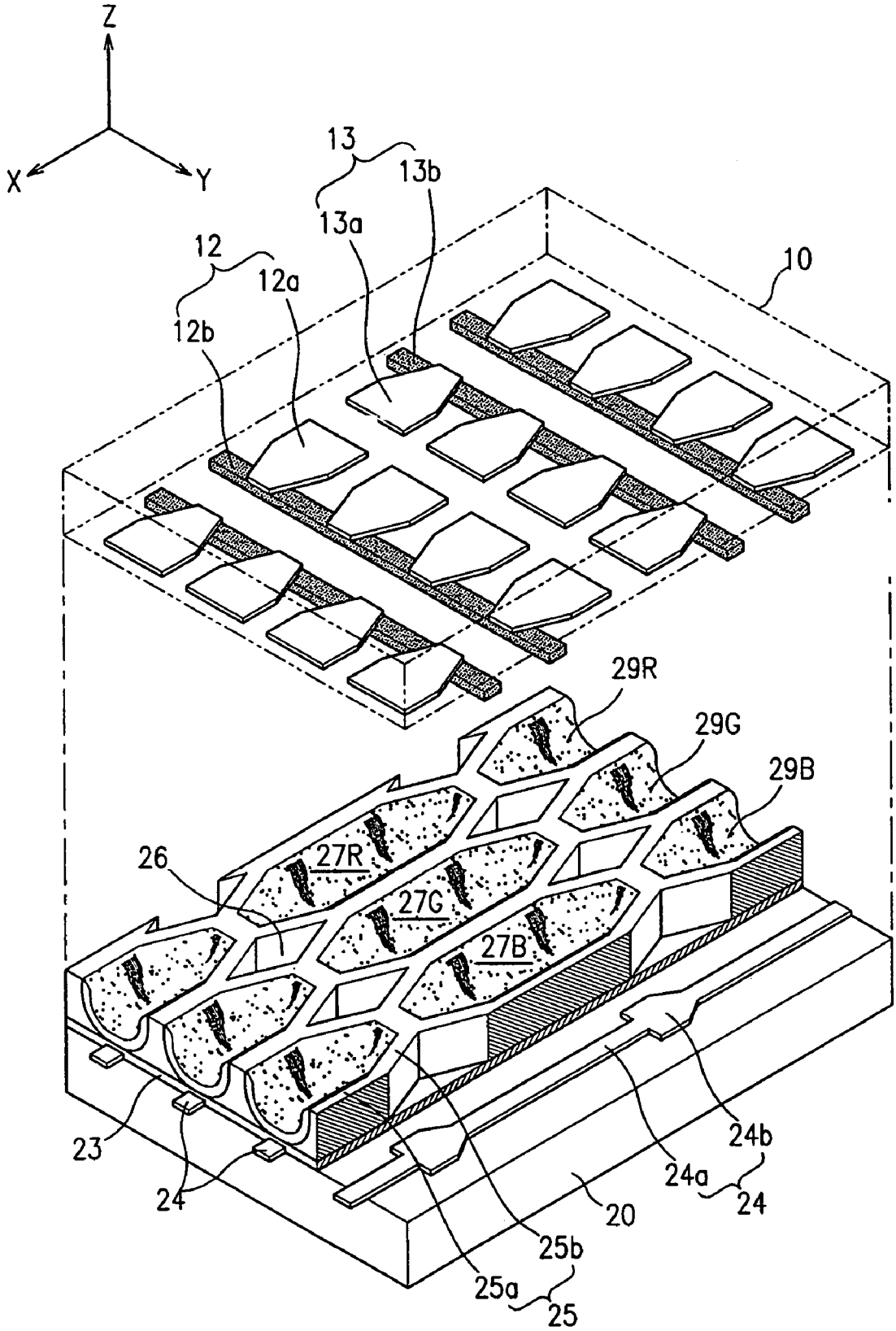
FIG. 22 is a partial exploded perspective view of a plasma display panel according to a tenth embodiment of the present invention.
Figure 23:
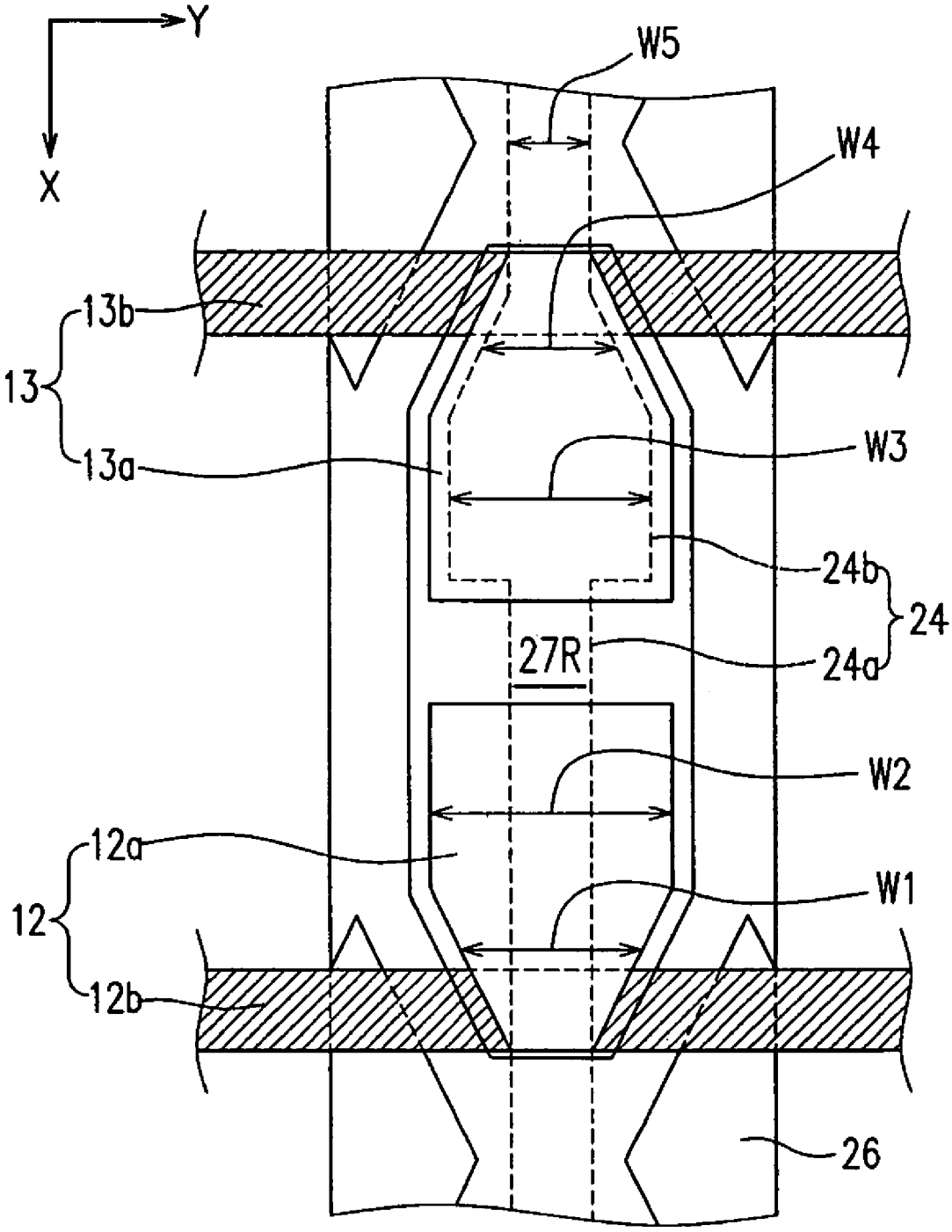
FIG. 23 is a partial enlarged view of FIG. 22.

FIG. 22 is a partial exploded perspective view of a plasma display panel according to a tenth embodiment of the present invention, and FIG. 23 is a partial enlarged view of FIG. 22.

In the plasma display panel (PDP) according to the tenth embodiment, barrier ribs 25 define non-discharge regions 26 and discharge cells 27R, 27G, and 27B as in the first embodiment. Further, discharge sustain electrodes 12 and 13 are formed along a direction (direction Y) substantially perpendicular to the direction address electrodes 24 are formed. Discharge sustain electrodes 12 are common electrodes, and discharge sustain electrodes 13 are scan electrodes. Scan electrodes 13 and common electrodes 12 include bus electrodes 13*b* and 12*b*, respectively, that extend along the direction address electrodes 24 are formed (direction Y). Scan electrodes 13 and common electrodes 12 also include protrusion electrodes 13*a* and 12*a*, respectively, that are extended respectively from bus electrodes 13*b* and 12*b*.

For each row of discharge cells 27R, 27G, and 27B along direction Y, bus electrodes 12*b* are extended along one end of discharge cells 27R, 27G, and 27B, and bus electrodes 13*b* are extended into an opposite end of discharge cells 27R, 27G, and 27B. Therefore, each of the discharge cells 27R, 27G, and 27B has one of the bus electrodes 12*b* positioned over one end, and one of the bus electrodes 13*b* positioned over its other end. Protrusion electrodes 12*a* overlap and protrude from corresponding bus electrode 12*b* into the areas of the discharge cells 27R, 27G, and 27B. Also, protrusion electrodes 13*a* overlap and protrude from the corresponding bus electrode 13*b* into the areas of discharge cells 27R, 27G, and 27B. Therefore, one protrusion electrode 12*a* and one protrusion electrode 13*a* are formed opposing one another in each area corresponding to each of the discharge cells 27R, 27G, and 27B.

Proximal ends of protrusion electrodes 12*a* and 13*a* (i.e., where protrusion electrodes 12*a* and 13*a* are attached to and extend from bus electrodes 12*b* and 13*b*, respectively) are formed corresponding to the shape of the ends of discharge cells 27R, 27G, and 27B. That is, the proximal ends of protrusion electrodes 12*a* and 13*a* reduce in width along direction Y as the distance from the center of discharge cells 27R, 27G, and 27B along direction X is increased to thereby correspond to the shape of the ends of discharge cells 27R, 27G, and 27B.

In the tenth embodiment, address electrodes 24 include enlarged regions 24*b* formed corresponding to the shape and location of protrusion electrodes 13*a* of scan electrodes 13. Enlarged regions 24*b* increase an area of scan electrodes 13 that oppose address electrodes 24. In more detail, address electrodes 24 include line regions 24*a* formed along direction X, and enlarged regions 24*b* formed at predetermined locations and expanding along direction Y corresponding to the shape of protrusion electrodes 13*a* as described above.

As shown in FIG. 23, when viewed from a front of the PDP, areas of enlarged regions 24*b* of address electrodes 24 opposing distal ends of protrusions 13*a* of scan electrodes 13 are substantially rectangular having width W3, and areas of enlarged regions 24*b* of address electrodes 24 opposing proximal ends of protrusions 13*a* of scan electrodes 13 are substantially wedge-shaped having width W4 that is less than width W3 and decreases gradually as bus electrodes 13*b* are neared. With width W5 corresponding to the width of line regions 24*a* of address electrodes 24, the following inequalities are maintained: W3>W5 and W4>W5.

With the formation of enlarged regions 24*b* at areas opposing scan electrodes 13 of address electrodes 24 as described above, address discharge is activated when an address voltage is applied between address electrodes 24 and scan electrodes 13, and the influence of common electrodes 12 is not received. Accordingly, in the PDP of the tenth embodiment, address discharge is stabilized such that crosstalk is prevented during address discharge and sustain discharge, and an address voltage margin is increased.

Figure 24:
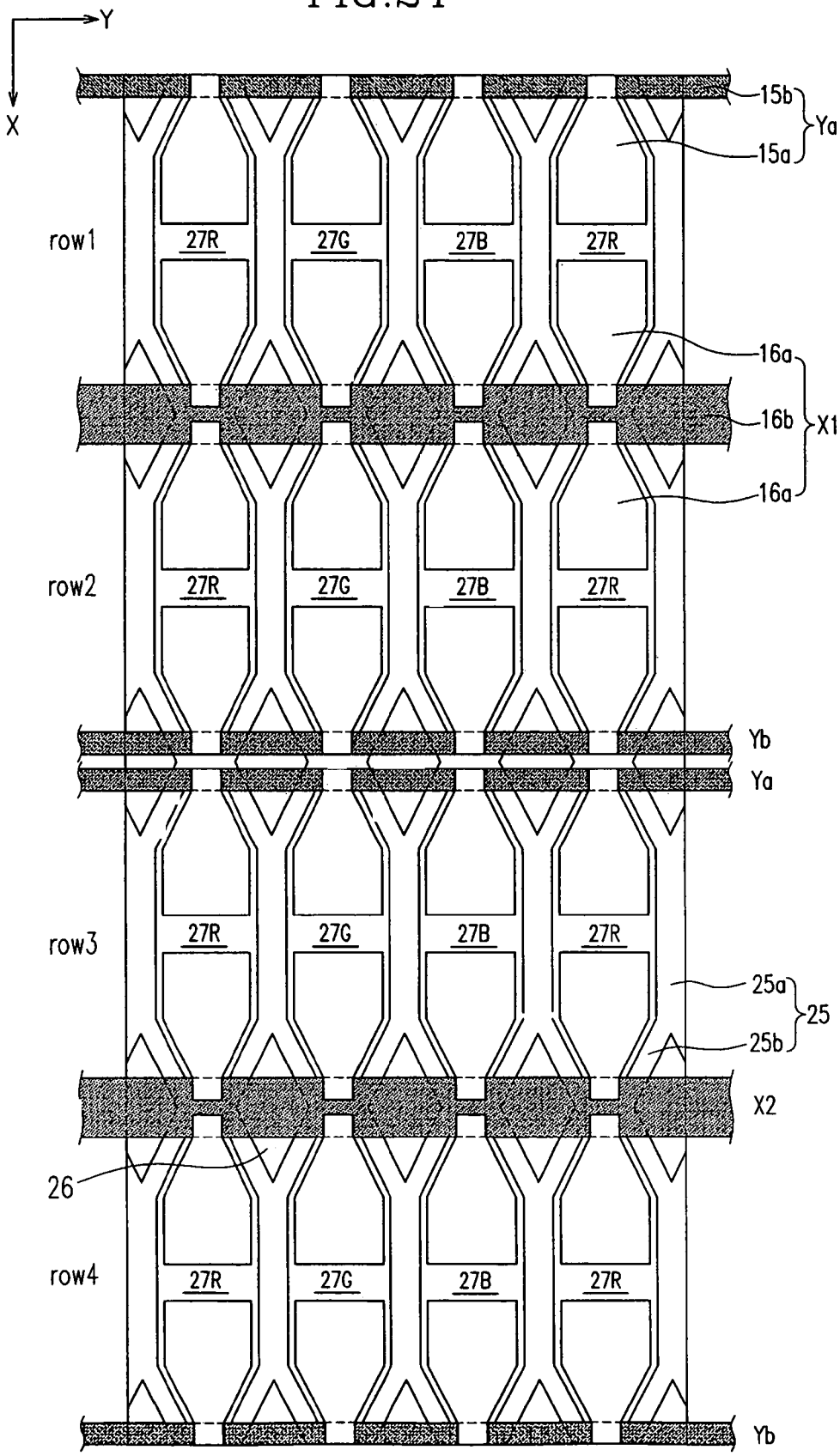
FIG. 24 is a partial plan view of a plasma display panel according to an eleventh embodiment of the present invention.
Figure 25:
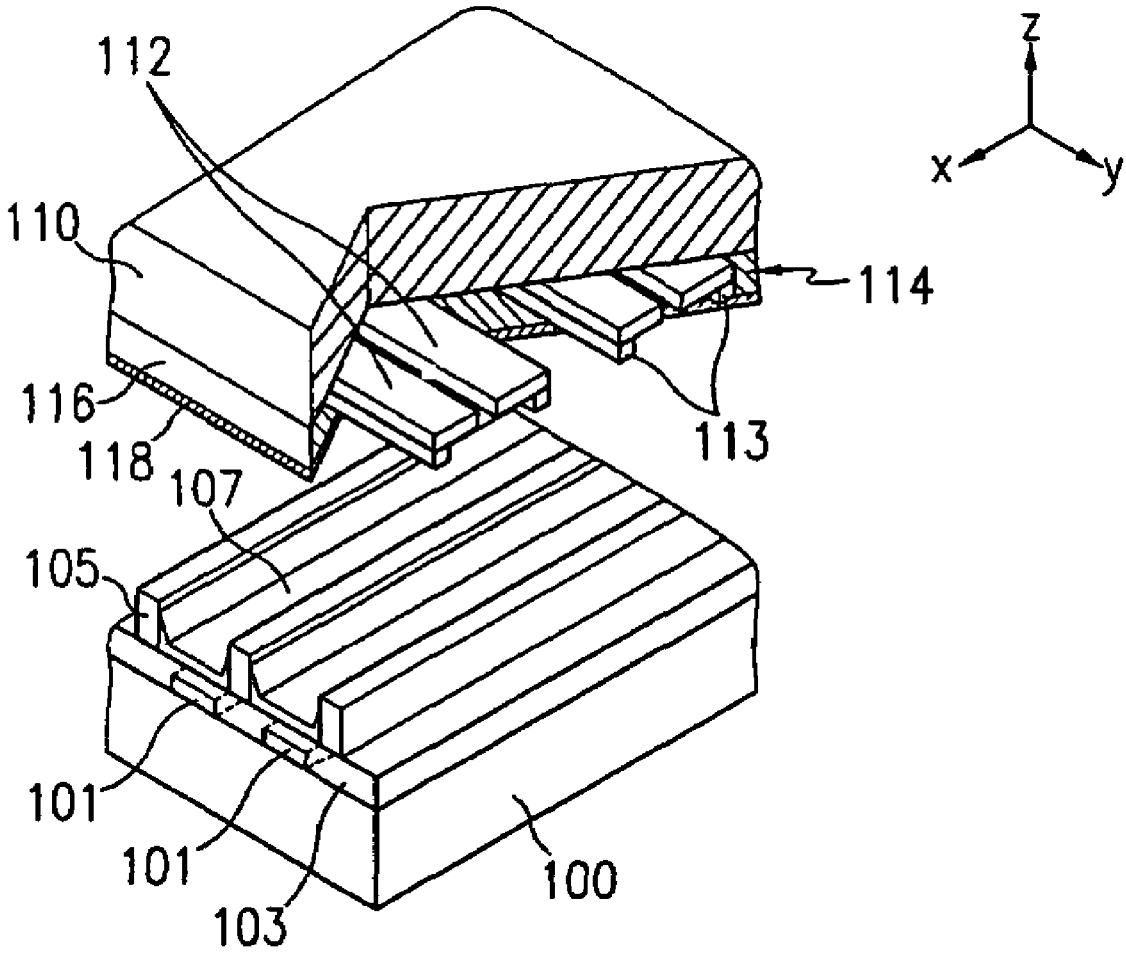
FIG.25(PRIOR ART)
FIG. 25 is a partially cutaway perspective view of a conventional plasma display panel.
Figure 26:
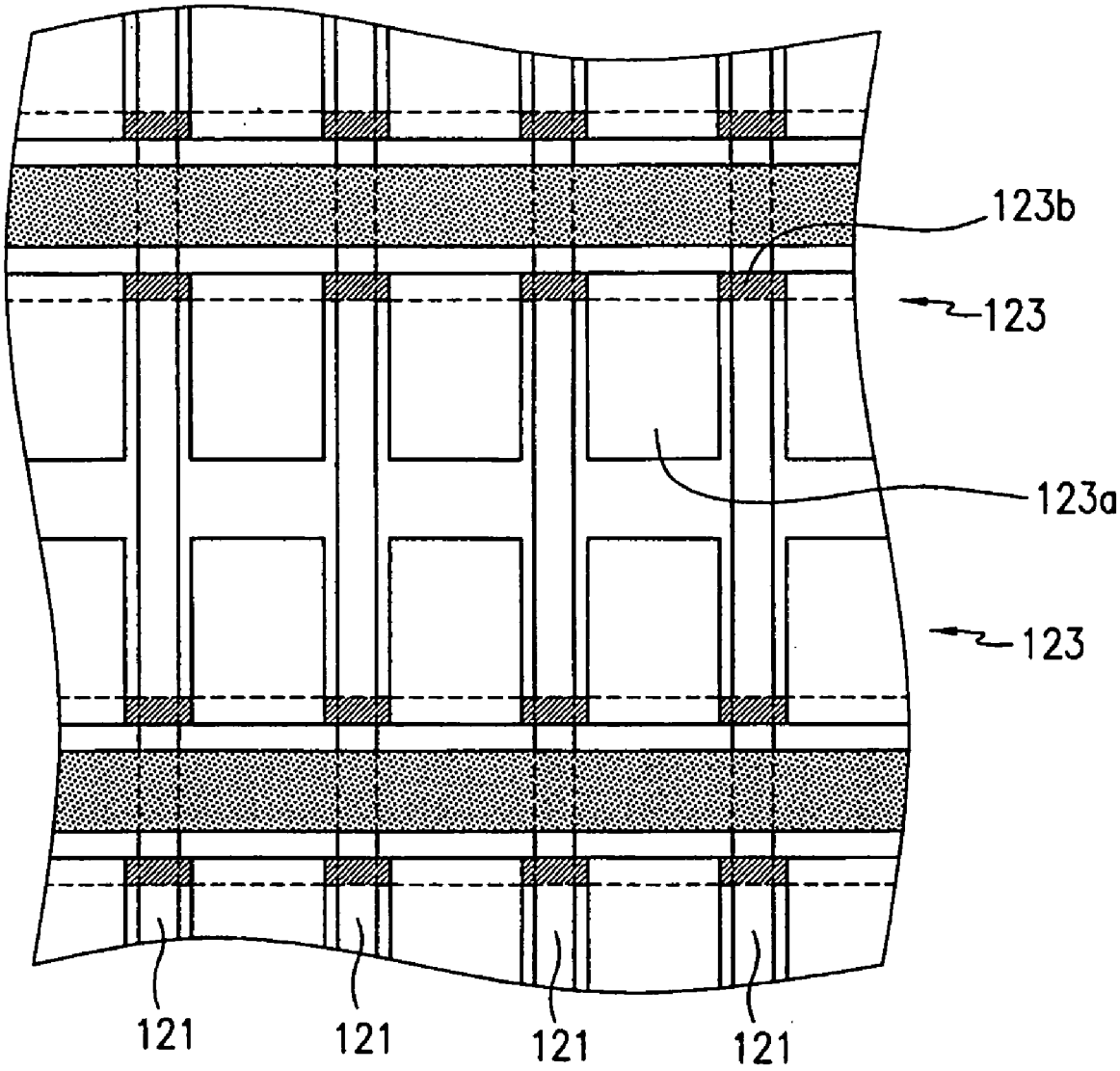
FIG.26(PRIOR ART)
FIG. 26 is a partial plan view of a conventional plasma display panel having a striped barrier rib structure.
Figure 27:
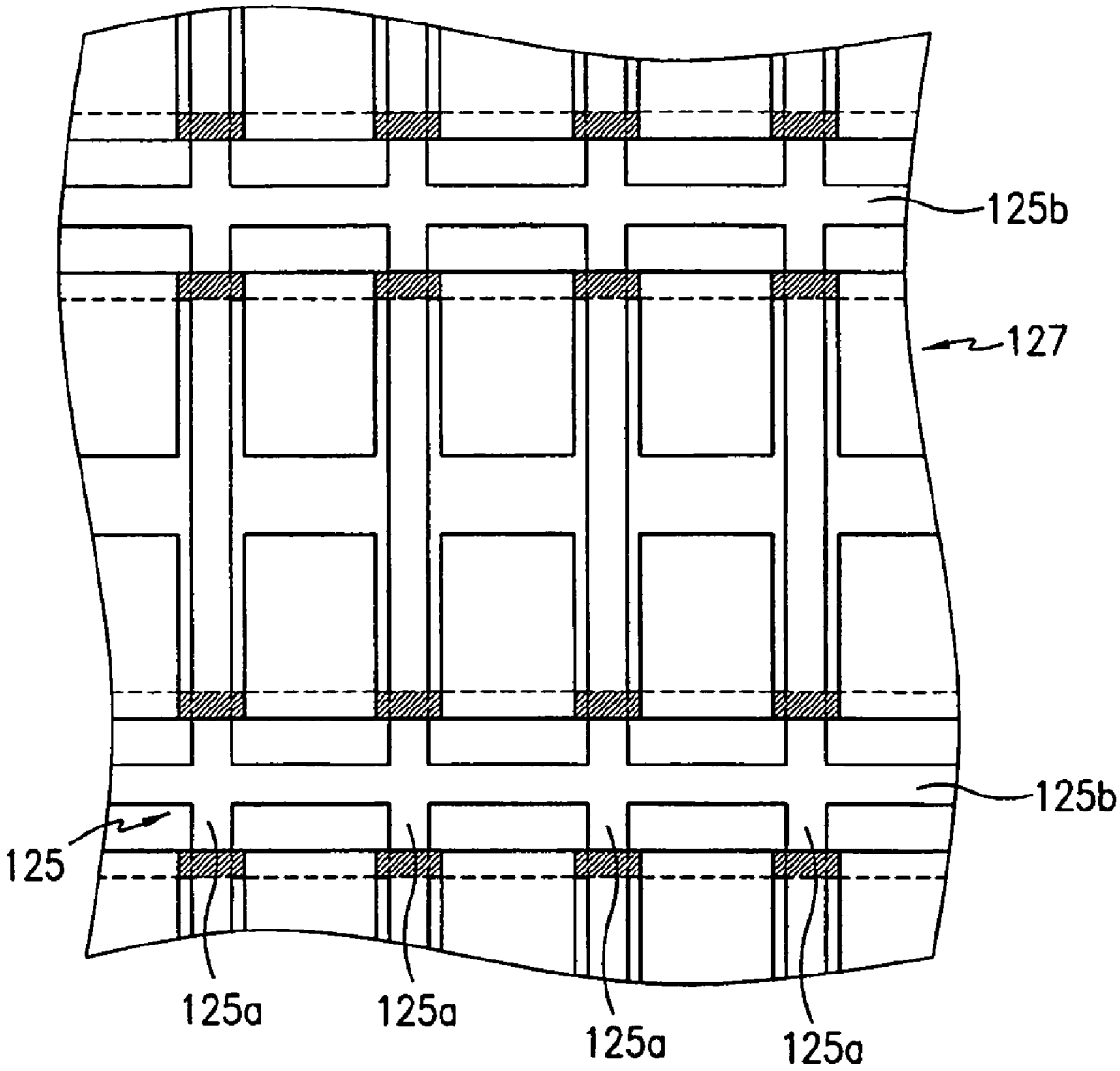
FIG.27(PRIOR ART)
FIG. 27 is a partial plan view of a conventional plasma display panel having a matrix barrier rib structure.

FIG. 24 is a partial plan view of a plasma display panel according to an eleventh embodiment of the present invention.

In the plasma display panel (PDP) according to the eleventh embodiment, barrier ribs 25 define non-discharge regions 26 and discharge cells 27R, 27G, and 27B as in the first embodiment. Further, discharge sustain electrodes are formed along a direction (direction Y) substantially perpendicular to the direction address electrodes 24 are formed. The sustain electrodes include scan electrodes (Ya, Yb) and common electrodes Xn (where n=1, 2, 3, . . . ). Scan electrodes (Ya, Yb) and common electrodes Xn include bus electrodes 15*b* and 16*b*, respectively, that extend along the direction address electrodes 24 are formed (direction Y), and protrusion electrodes 15*a* and 16*a*, respectively, that are extended respectively from bus electrodes 15*b* and 15*b* such that a pair of protrusion electrodes 15*a* and 16*a* oppose one another in each discharge cell 27R, 27G, and 27B. Scan electrodes (Ya, Yb) act together with address electrodes 24 to select discharge cells 27R, 27G, and 27B, and common electrodes Xn act to initialize discharge and generate sustain discharge.

Letting the term "rows" be used to describe lines of discharge cells 27R, 27G, and 27B adjacent along direction Y, bus electrodes 16*b* of common electrodes Xn are provided such that one of the bus electrodes 16*b* is formed overlapping ends of discharge cells 27R, 27G, and 27B in every other pair of rows adjacent along direction X. Further, bus electrodes 15*b* of scan electrodes (Ya, Yb) are provided such that one bus electrode 15*b* of scan electrodes Ya and one bus electrode 15*b* of scan electrodes Yb are formed overlapping ends of discharge cells 27R, 27G, and 27B in every other pair of rows adjacent along direction X. Along this direction X, scan electrodes (Ya, Yb) and common electrodes Xn are provided in an overall pattern of Ya-X1-Yb-Ya-X2-Yb-Ya-X3 -Yb- . . . -Ya-Xn-Yb. With this configuration, common electrodes Xn are able to participate in the discharge operation of all discharge cells 27R, 27G, and 27B.

Further, bus electrodes 15*b* and 16*b* respectively of scan electrodes (Ya, Yb) and common electrodes Xn are positioned also outside the region of discharge cells 27R, 27G, and 27B. This prevents a reduction in the aperture ratio by bus electrodes 15*b* and 16*b* such that a high degree of brightness is maintained. In addition, bus electrodes 16*b* of common electrodes Xn are formed covering a greater area along direction X than pairs of bus electrodes 15*b* of scan electrodes (Ya, Yb). This is because bus electrodes 16*b* of common electrodes Xn absorb outside light to thereby improve contrast.

In the PDP of the present invention described above, non-discharge regions are formed between discharge cells, the discharge cells are formed to maximize discharge efficiency, and the phosphor layers are formed closer to the discharge sustain electrodes to realize improved efficiency in converting vacuum ultraviolet rays to visible light.

In addition, each of the discharge cells is formed into independent spaces so that crosstalk between adjacent discharge cells is prevented. Also, the first barrier rib members, which are aligned with the address electrodes, and the second barrier rib members, which intersect over the address electrodes, are formed to different heights to thereby allow smooth and efficient evacuation of the PDP during manufacture.

Although embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A plasma display panel, comprising:

a first substrate and a second substrate provided opposing one another with a predetermined gap therebetween;

address electrodes formed on the second substrate;

barrier ribs mounted between the first substrate and the second substrate, the barrier ribs defining a plurality of discharge cells and a plurality of non-discharge regions;

phosphor layers formed within each of the discharge cells; and discharge sustain electrodes formed on the first substrate, wherein the non-discharge regions are formed in areas encompassed by discharge cell abscissas that pass through centers of adjacent discharge cells and discharge cell ordinates that pass through centers of adjacent discharge cells, wherein each of the discharge cells is formed such that ends of the discharge cells gradually decrease in width along a direction the discharge sustain electrodes are formed as a distance from a center of the discharge cells is increased along a direction the address electrodes are formed, wherein the discharge sustain electrodes include bus electrodes that extend such that a pair of the bus electrodes is provided for each of the discharge cells, and protrusion electrodes formed extending from each of the bus electrodes such that a pair of opposing protrusion electrodes is formed within areas corresponding to each discharge cell, each protrusion electrode joining a respective bus electrode at a respective single junction and tapering from a larger width within a discharge cell to a smaller width at the respective single junction;

wherein a distal end of each of the protrusion electrodes opposite proximal ends connected to and extended from the bus electrodes is formed including an indentation, and a first discharge gap and a second discharge gap of different sizes are formed between distal ends of opposing protrusion electrodes, and wherein the discharge cells are filled with discharge gas containing 10% or more Xenon.

2. The plasma display panel of claim 1, wherein the discharge cells are filled with discharge gas containing 10-60% Xenon.

3. The plasma display panel of claim 2, wherein if A is a sum of a size of a first discharge gap and a second discharge gap, the following condition is satisfied, $$167 \leqq F(A+Xe) \leqq 240,$$

where F(A+Xe) is the sum of the A values with the Xenon (Xe) content values in which there has been no conversion in the units of micrometers for the A values and the units of percentage for the Xe content values.

4. A plasma display panel, comprising:

a first substrate and a second substrate provided opposing one another with a predetermined gap therebetween;

address electrodes formed on the second substrate;

barrier ribs mounted between the first substrate and the second substrate, the barrier ribs defining a plurality of discharge cells and a plurality of non-discharge regions;

phosphor layers formed within each of the discharge cells; and discharge sustain electrodes formed on the first substrate, wherein the non-discharge regions are formed in areas encompassed by discharge cell abscissas that pass through centers of adjacent discharge cells and discharge cell ordinates that pass through centers of adjacent discharge cells, wherein each of the discharge cells is formed such that ends of the discharge cells gradually decrease in width along a direction the discharge sustain electrodes are formed as a distance from a center of the discharge cells is increased along a direction the address electrodes are formed, wherein the discharge sustain electrodes include bus electrodes that extend such that a pair of the bus electrodes is provided for each of the discharge cells, and protrusion electrodes formed extending from each of the bus electrodes such that a pair of opposing protrusion electrodes is formed within areas corresponding to each discharge cell;

wherein a distal end of each of the protrusion electrodes opposite proximal ends connected to and extended from the bus electrodes is formed including an indentation, and a first discharge gap and a second discharge gap of different sizes are formed between distal ends of opposing protrusion electrodes, wherein the discharge cells are filled with discharge gas containing 10- 60% Xenon, and wherein if A is a sum of a size of a first discharge gap and a second discharge gap, the following condition is satisfied, $$167 \leqq F(A+Xe) \leqq 240,$$

where F(A+Xe) is the sum of the A values with the Xenon (Xe) content values in which there has been no conversion in the units of micrometers for the A values and the units of percentage for the Xe content values.

* * * * *